US011779831B2

(12) United States Patent
Gastel

(10) Patent No.: US 11,779,831 B2
(45) Date of Patent: Oct. 10, 2023

(54) SUPPORT MEMBER FOR ELEVATING A RETAINING WALL PANEL

(71) Applicant: Dylan Gastel, Auburndale, MA (US)

(72) Inventor: Dylan Gastel, Auburndale, MA (US)

( * ) Notice: Subject to any disclaimer, the term of this patent is extended or adjusted under 35 U.S.C. 154(b) by 346 days.

(21) Appl. No.: 16/994,083

(22) Filed: Aug. 14, 2020

(65) Prior Publication Data

US 2021/0046377 A1 Feb. 18, 2021

Related U.S. Application Data

(60) Provisional application No. 62/887,900, filed on Aug. 16, 2019.

(51) Int. Cl.

| | |
|---|---|
| ***A63C 19/10*** | (2006.01) |
| ***E02D 29/02*** | (2006.01) |
| *E04G 17/04* | (2006.01) |

(52) U.S. Cl.

CPC ..... *A63C 19/10* (2013.01); *E02D 29/0266* (2013.01); *E02D 2600/40* (2013.01)

(58) Field of Classification Search

CPC ..... A63C 19/00; A63C 19/04; A63C 19/10; E04G 17/00; E04G 17/04

USPC ..... 472/88–94; 446/102–104

See application file for complete search history.

(56) References Cited

U.S. PATENT DOCUMENTS

| | | | | |
|---|---|---|---|---|
| 2,869,692 | A * | 1/1959 | Hassett | E06B 9/52 52/578 |
| 3,771,891 | A | 11/1973 | Nirenski et al. | |
| 3,930,647 | A | 1/1976 | Berlemont | |
| 4,392,647 | A | 7/1983 | Golebieski | |
| 4,676,762 | A * | 6/1987 | Ballard | A63H 33/105 446/124 |
| 5,134,857 | A | 8/1992 | Burley | |
| 5,820,470 | A | 10/1998 | Saunders | |
| 6,230,451 | B1 | 5/2001 | Stoller | |
| 10,300,365 | B2 * | 5/2019 | Merlot | A63C 19/10 |
| 2006/0038380 | A1 * | 2/2006 | Howell | B60D 1/00 280/443 |

* cited by examiner

*Primary Examiner* — Kien T Nguyen
(74) *Attorney, Agent, or Firm* — Robinson & Cole LLP

(57) ABSTRACT

A support member for elevating a retaining wall panel includes a base arrangement with a first area and a second area. The base arrangement engages an underlying mounting surface. A height elevating section extends from the base arrangement proximate to the second area to a third area. The height elevating section has a receiving area configured to receive a wall panel. A sloped surface extends between the base arrangement proximate the first area and the height elevating section proximate to the third area. The sloped surface is configured to support a load bearing panel.

36 Claims, 25 Drawing Sheets

SUPPORT MEMBER FOR ELEVATING A RETAINING WALL PANEL

CROSS REFERENCE TO RELATED APPLICATION

This application claims the benefit of U.S. Provisional Patent Application Ser. No. 62/887,900 filed on Aug. 16, 2019, the entirety of which is incorporated herein by reference in its entirety.

TECHNICAL FIELD

The present invention is directed to a support member for elevating a panel of a retaining wall. Specifically, the present invention is directed to a support member for use when building an ice skating rink on ground that is sloped or otherwise unleveled.

BACKGROUND

In cold climates it is common to create a structure on a yard, field, or hard court that acts as a perimeter for an outdoor ice skating rink. Prior art ice rinks are often made from wooden, plastic, or metal boards and brackets that form the perimeter of the rink and a water impermeable liner that covers the perimeter and provides a barrier for the water and ice. Ice skating rinks that are set up in this manner must be portable and easily assembled because the ice rinks are moved and are erected and taken down on an annual basis. It is important that the assembly is easy while also producing a safe, complete ice skating rink for the user.

One of the main challenges in constructing outdoor temporary ice skating rinks is the slope of the underlying surface. If the underlying surface is sloped, the water that will eventually freeze into ice gathers or pools at the lower end of the rink due to the force of gravity. As a result, the area under the ice rink must be relatively flat or the water will collect and freeze into ice that is uneven and does not reach entirely across the ice rink. Prior art outdoor, temporary ice skating rinks allow for a maximum of one vertical foot of slope across the entire ice rink.

There are no economically feasible or widely available solutions for allowing more than one vertical foot of slope across the area of the portable ice rink. One prior art solution, is to have the yard or surface professionally graded. This option is prohibitively time intensive and costly for the land owner. Having a suitably graded surface is often undesirable to the land owner because it can significantly hinder drainage. Another prior art solution is to use taller boards to hold deeper water at one end of the rink. These deep-water solutions use heavily-reinforced boards to withstand the very large force generated by several feet of water pressing against the board. This option is prohibitively expensive because the wall structures must be highly reinforced to withstand the force generated by the water. This option also requires a very large amount of friction between the boards and the ground itself, necessitating large metal or plastic spikes or stakes that penetrate the underlying surface. Penetrating the underlying surface in this manner is also often undesirable to the land owner.

Based on the foregoing, there is a need in the art for an economically feasible, easily assembled temporary ice skating rink that allows more than one foot of slope across the rink.

SUMMARY

There is disclosed herein a support member for elevating a retaining wall panel. The support member includes a base arrangement having a first area (A) and a second area (B). The base arrangement engages a mounting surface (e.g., ground, lawn, asphalt, etc.). A height elevating section extends from the base arrangement near the second area (B) to a third area (C) vertically above the second area (B). The height elevating section has a receiving area that receives a wall panel. A sloped surface extends between the base arrangement near the first area (A) and the height elevating section near the third area (C). The sloped surface supports a load bearing panel extending between the first area (A) and the third area (C).

In some embodiments the sloped surface includes at least one mounting area that receives a lateral brace member.

In some embodiments, the support member includes a receiving area that secures to a tension member.

In some embodiments, the base arrangement includes an anti-skid feature.

In some embodiments, the support member is a unitary body.

In some embodiments, a gusset extends between the base arrangement, the height elevating section and the sloped surface.

In some embodiments, the base arrangement, the height elevating section and the sloped surface are connected to one another.

In some embodiments, an opening extends through the support member.

In some embodiments, the base arrangement, the height elevating section, and the sloped surface form one of a triangular shape and a A-shape.

In some embodiments, a first side face and a second side face of the support member define a lateral thickness (T1).

In some embodiments, the sloped surface is at a first angle $\delta$ relative to the base arrangement. In some embodiments the first angle $\delta$ is between about 30 degrees and about 60 degrees.

In some embodiments, the height elevating section has an edge oriented at a second angle $\alpha$ relative to the base arrangement. In some embodiments, the second angle $\alpha$ is less than 90 degrees.

In some embodiments, the height elevating section has an edge oriented at a second angle $\alpha$ relative to the base arrangement that is about 87 degrees.

In some embodiments, the receiving area has a slot defined by opposing side walls and a bottom extending therebetween. The opposing side walls are oriented at a third angle $\sigma$ that is less than the first angle $\delta$ such that the wall panel is in a vertical orientation when the base arrangement is positioned on the sloped mounting surface.

In some embodiments, the height elevating section extends a height (H1) and the base arrangement extends a length (L1). The support member has an aspect ratio equal to the thickness (T1) divided by a sum of the height (H1) plus the length (L1).

In some embodiments, the aspect ratio is a fractional number.

In some embodiments, the aspect ratio is greater than 1.0.

In some embodiments, the height elevating section slopes inwardly toward the first area (A).

In some embodiments, the height elevating section slopes outwardly away from the first area (A).

In some embodiments, the height elevating section is positioned a predetermined distance (H2) above the mounting surface.

In some embodiments, a lip extends from the base arrangement near the first area (A). The lip has a panel receiving area that receives an end of a load bearing panel therein.

There is also disclosed herein a retaining wall elevating structure including at least one support member and a load bearing panel on the support member.

In some embodiments of the retaining wall elevating structure, the load bearing panel extends in a sloped manner between the mounting surface near the first area (A) to the height elevating section near the third area (C).

In some embodiments of the retaining wall elevating structure, a wall panel is positioned vertically in the receiving area of the height elevating section.

In some embodiments of the retaining wall elevating structure, a water impermeable liner is draped over the wall panel and the load bearing panel.

In some embodiments of the retaining wall elevating structure, the load bearing panel is disposed on and extends over at least two support members.

In some embodiments of the retaining wall elevating structure, at least one lateral brace member extends between the two support members.

In some embodiments of the retaining wall elevating structure, the load bearing panel is supported by the lateral brace member.

In some embodiments of the retaining wall elevating structure, the support member is positioned substantially inwardly of the wall panel.

In some embodiments of the retaining wall elevating structure, the support members include a first support member size, a second support member size, and a third support member size. The first support member size is smaller than the second support member size and the second support member size is less than the third support member size.

In some embodiments of the retaining wall elevating structure, a wall panel is in each adjacent pair of the support members so that the wall panels all intersect a horizontal water level (WL).

In some embodiments of the retaining wall elevating structure, at least one shim is placed in the receiving area to adjust a height of the wall panel.

There is also disclosed herein an ice skating rink including the retaining wall system.

In some embodiments of the ice rink, the support members are positioned substantially inside the rink.

In some embodiments of the ice rink, a number of tension members extend under the water impermeable liner and are in frictional engagement with the mounting surface and at least one of the tension members is secured to each of two generally opposing support members.

In some embodiments of the ice rink, a number of tension members extend under the water impermeable liner and are in frictional engagement with the mounting surface and at least one of the tension members is secured to one of the support members and one of the brackets.

DETAILED DESCRIPTION

Figure 1A:
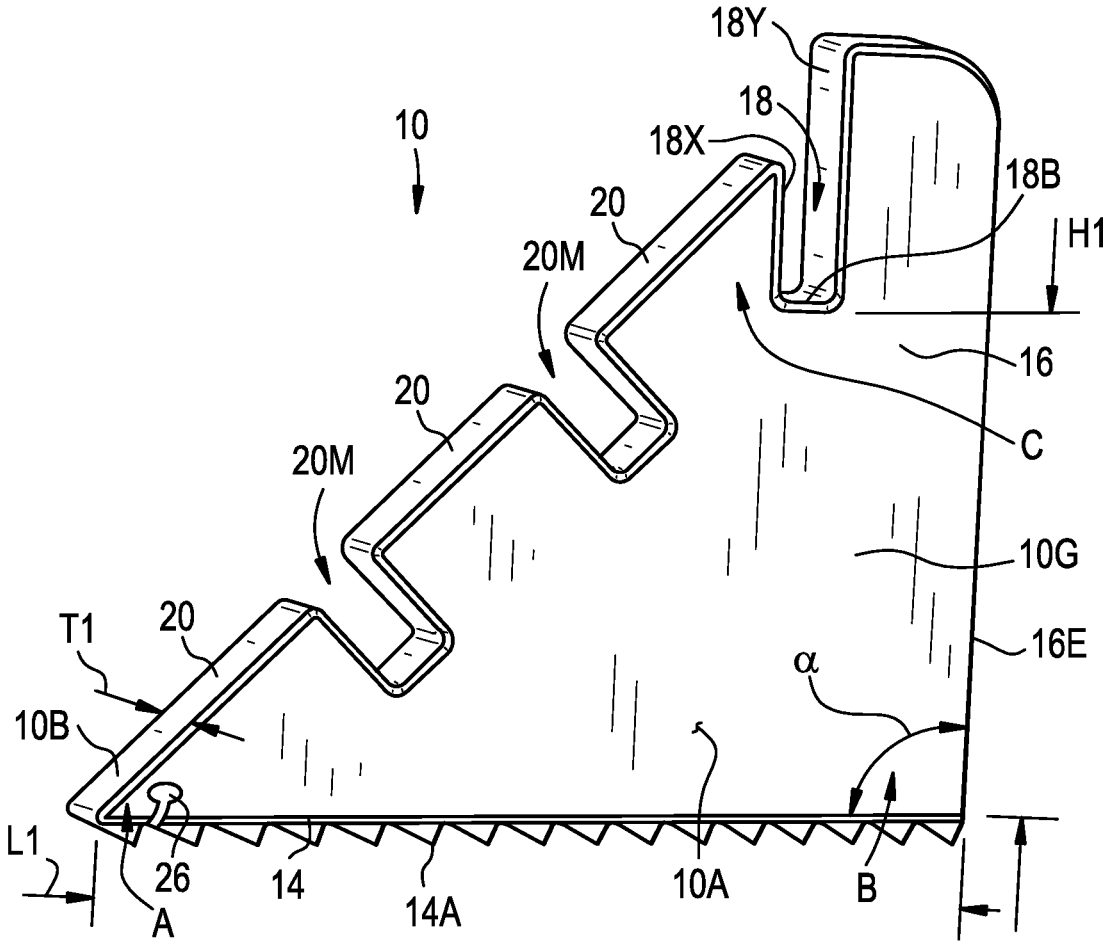
FIG. 1A depicts an isometric view of a first embodiment of a support member according to the present disclosure.
Figure 1B:
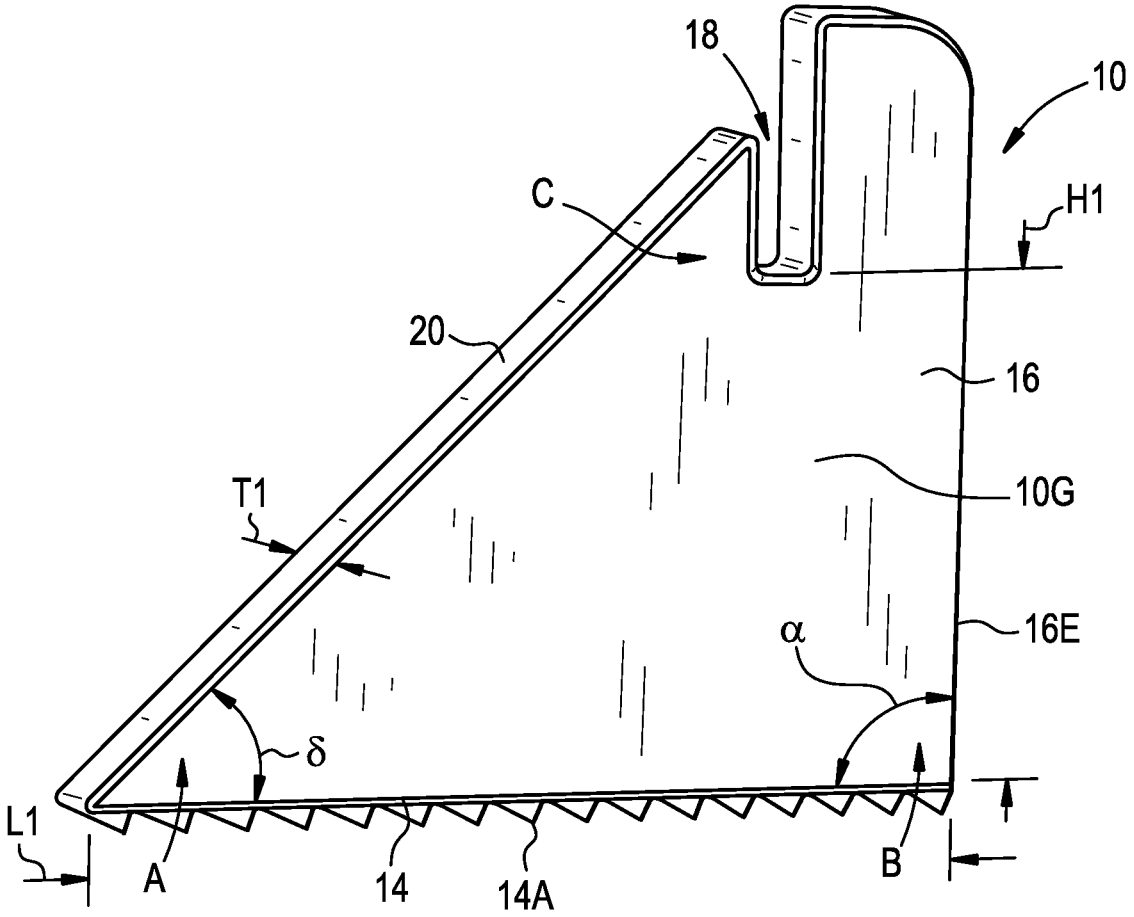
FIG. 1B depicts an isometric view of a second embodiment of a support member according to the present disclosure.
Figure 1C:
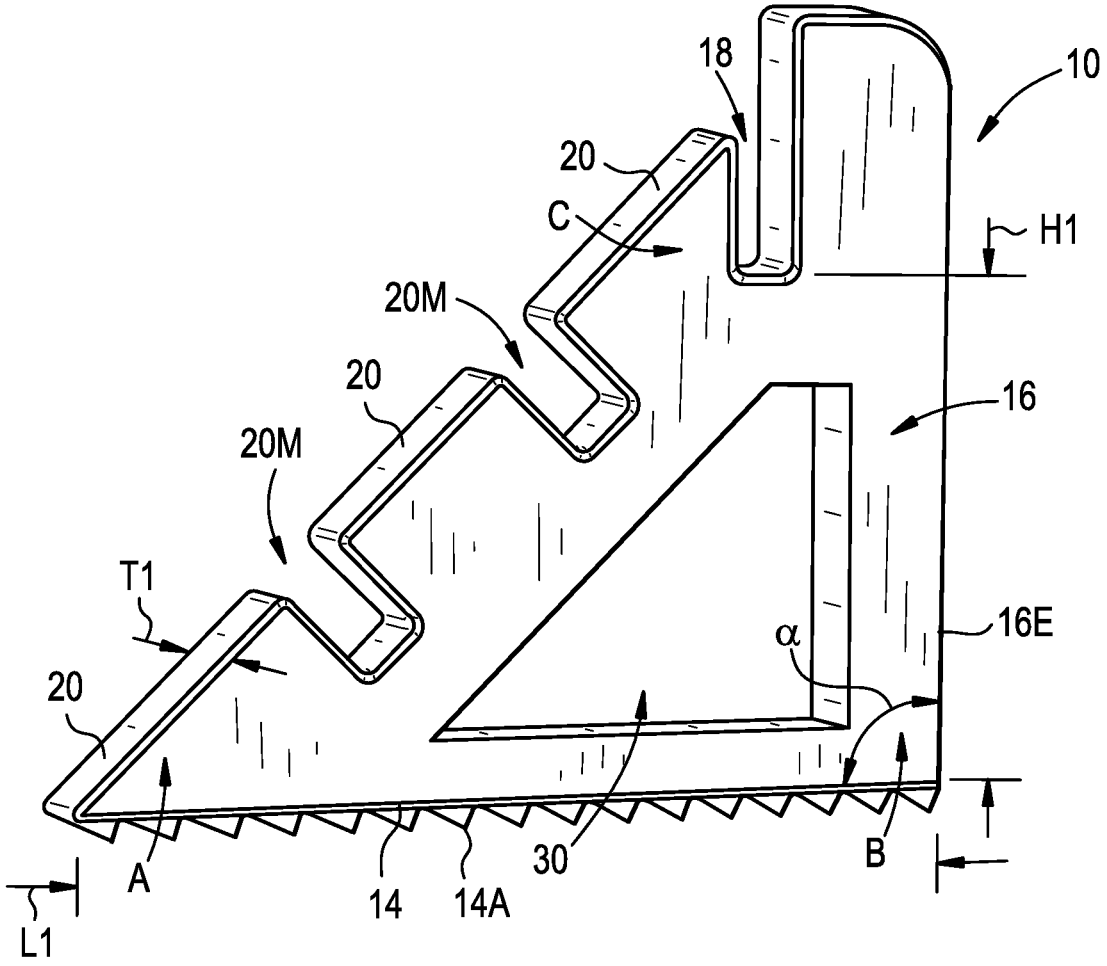
FIG. 1C depicts an isometric view of a third embodiment of a support member according to the present disclosure.
Figure 1D:
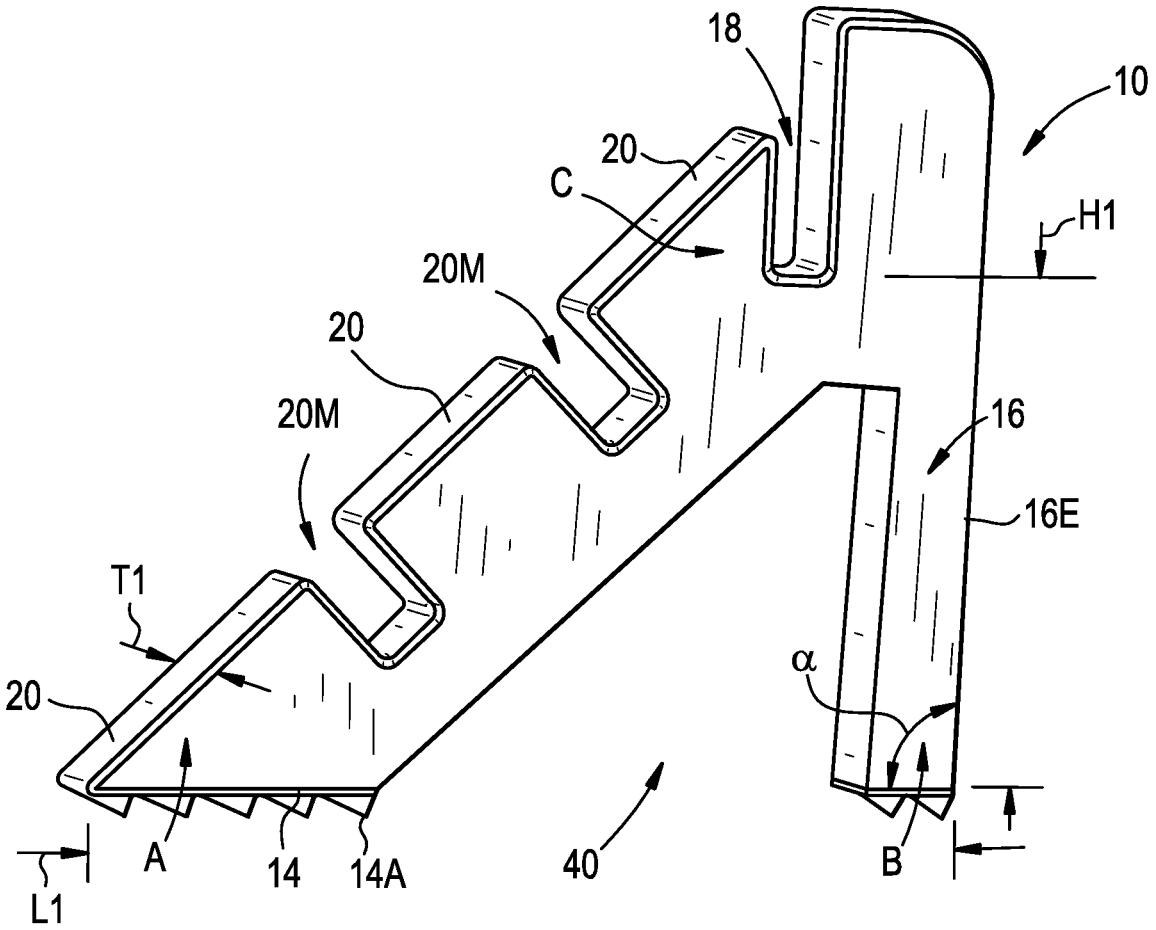
FIG. 1D depicts an isometric view of a fourth embodiment of a support member according to the present disclosure.
Figure 1E:
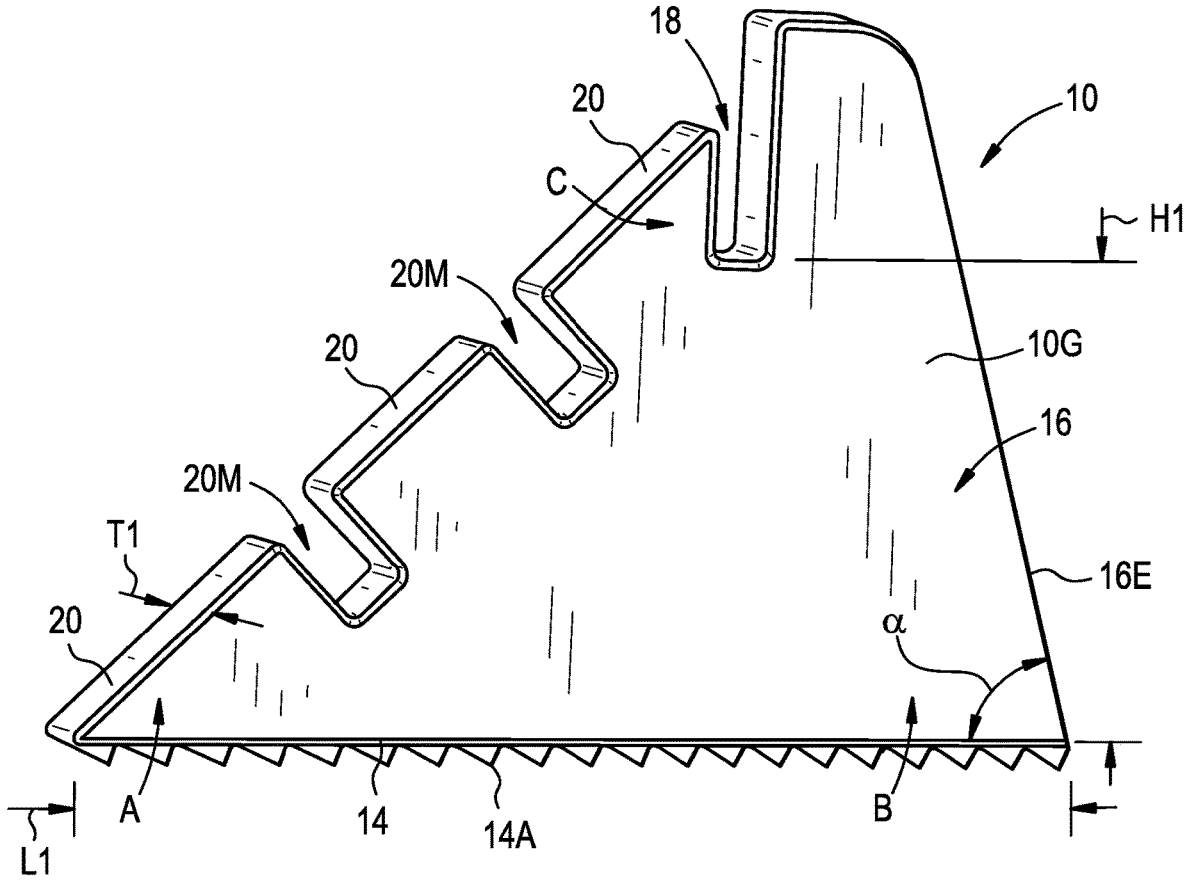
FIG. 1E depicts an isometric view of a fifth embodiment of a support member according to the present disclosure.
Figure 1F:
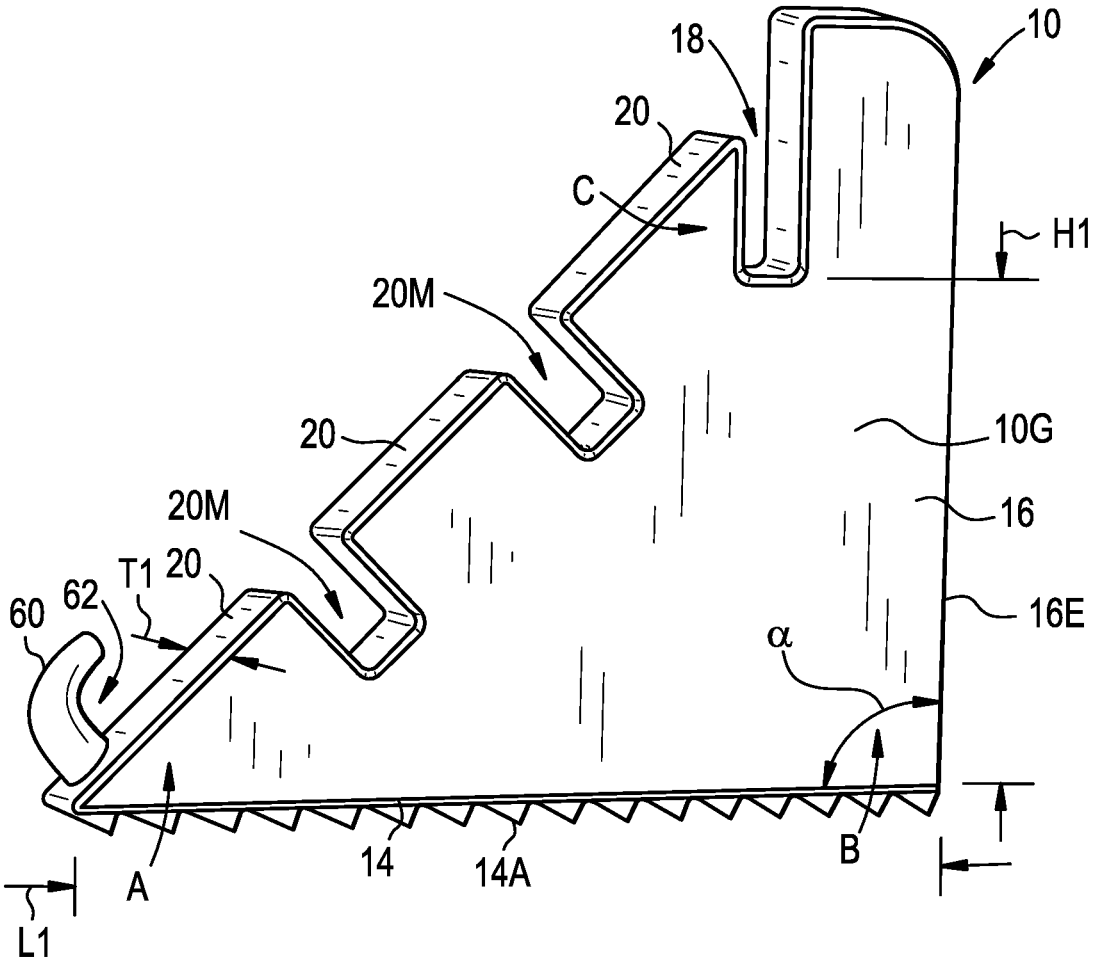
FIG. 1F depicts an isometric view of a sixth embodiment of a support member according to the present disclosure including a load bearing panel.

FIGS. 1A-1I depict various embodiments of a support member for elevating a retaining wall panel 12 that is generally designated by reference numeral 10. Referring to FIGS. 1A and 2, the support member 10 includes a base arrangement 14 having a first area A proximate to a first end of the support member and a second area B proximate to the second end opposite the first end. The base arrangement 14 engages a ground or mounting surface 1. A height elevating section 16 extends from the base arrangement 14 proximate to the second area B to a third area C. The height elevating section 16 has a receiving area 18 that receives a wall panel 12X. A sloped surface 20 extends between the base arrangement 14 proximate to the first area A and the height elevating section 16 proximate to the third area C. The sloped surface 20 supports a load bearing panel 22 extending between the first area A and the third area C.

Figure 1G:
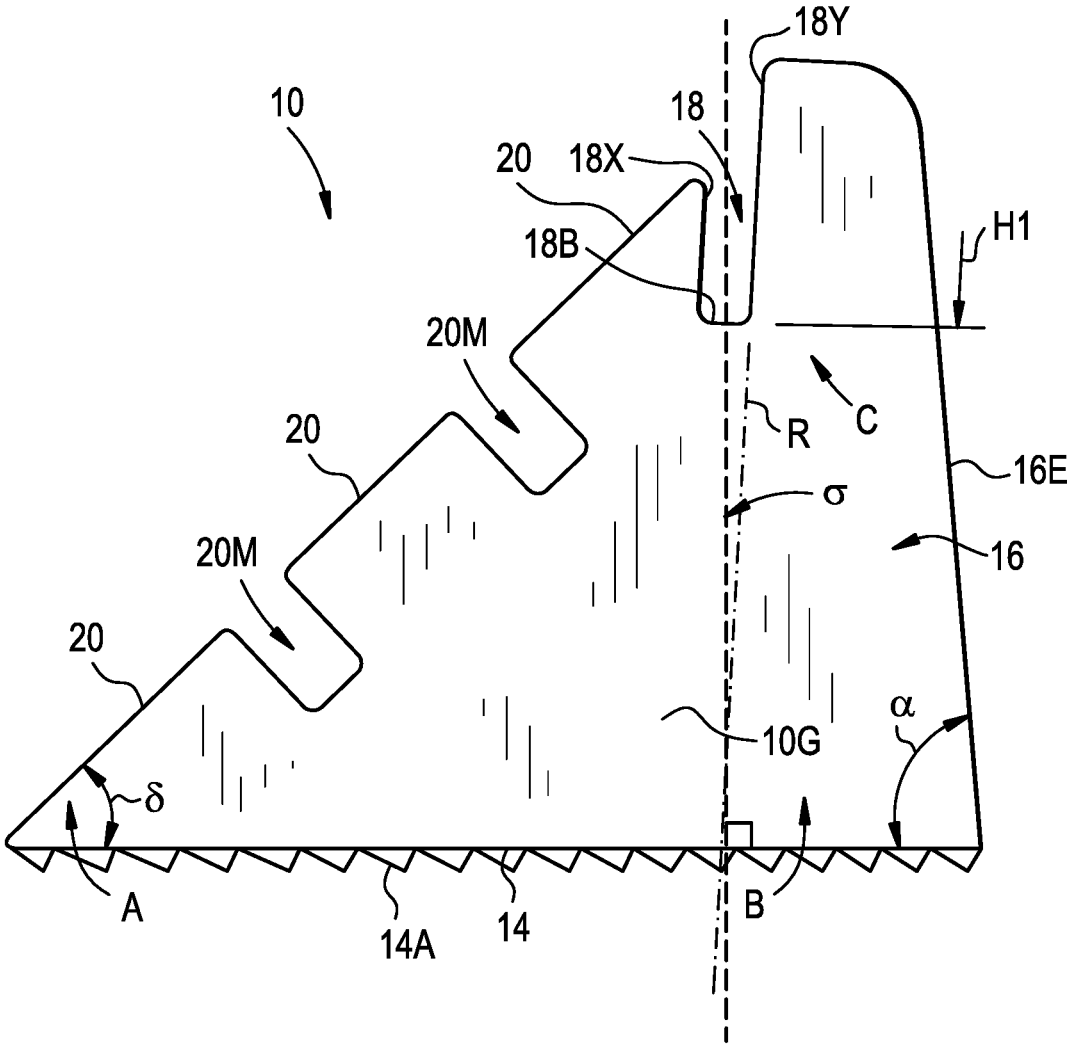
FIG. 1G depicts a side view of the support member of FIG. 1A.
Figure 1H:
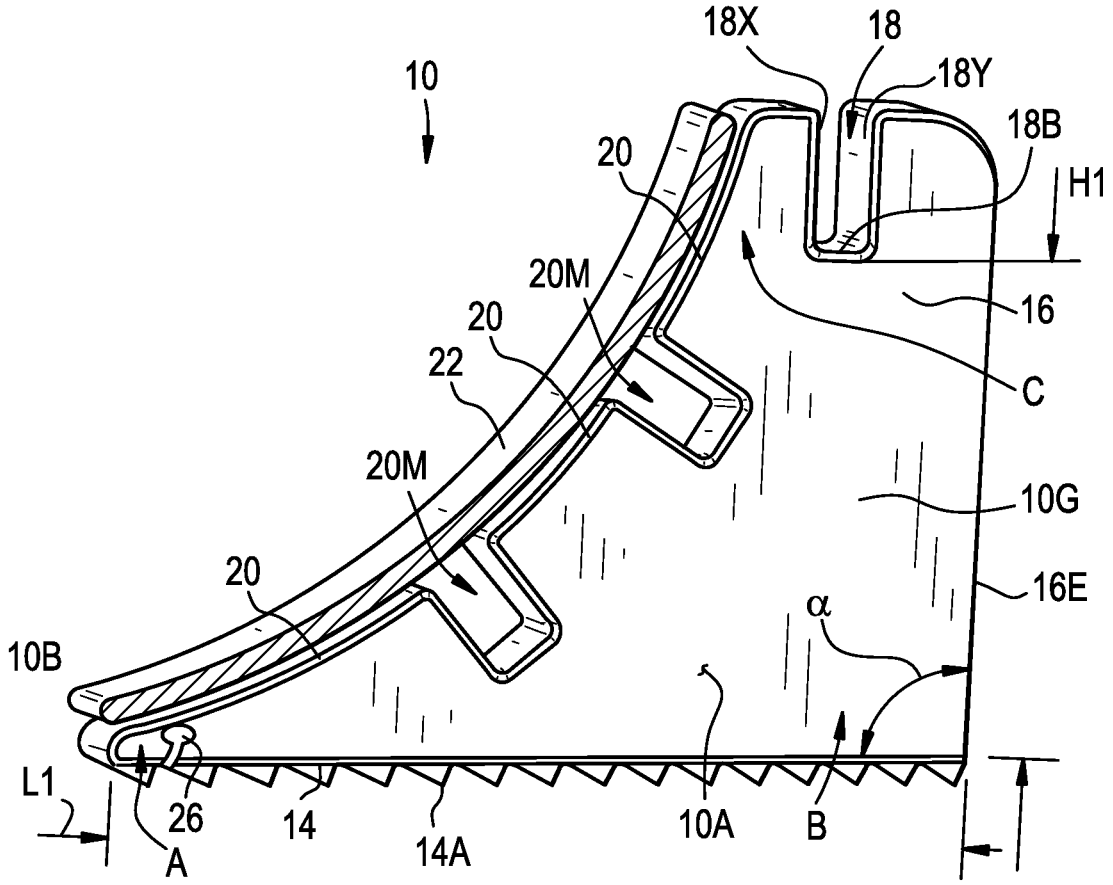
FIG. 1H depicts a side view of a seventh embodiment of a support member according to the present disclosure including a load baring panel.
Figure 1I:
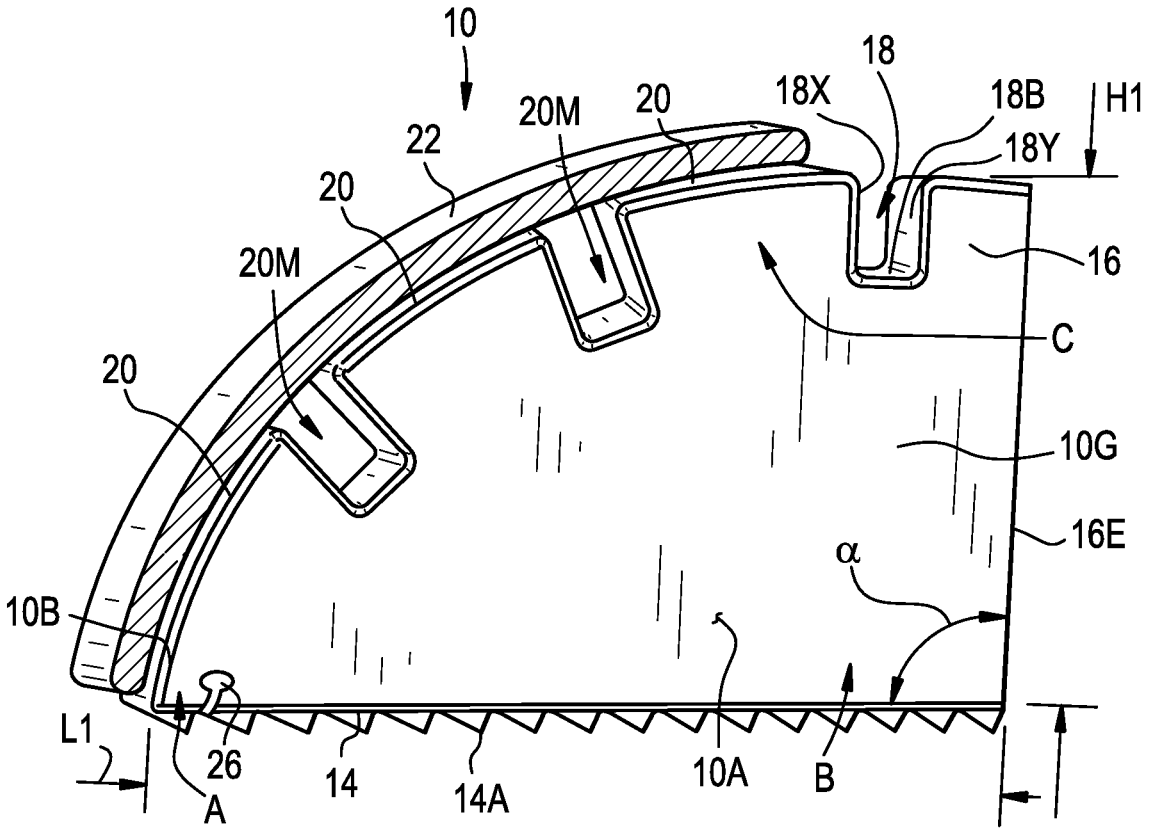
FIG. 1I depicts a side view of an eighth embodiment of a support member according to the present disclosure including a load bearing panel.
Figure 2:
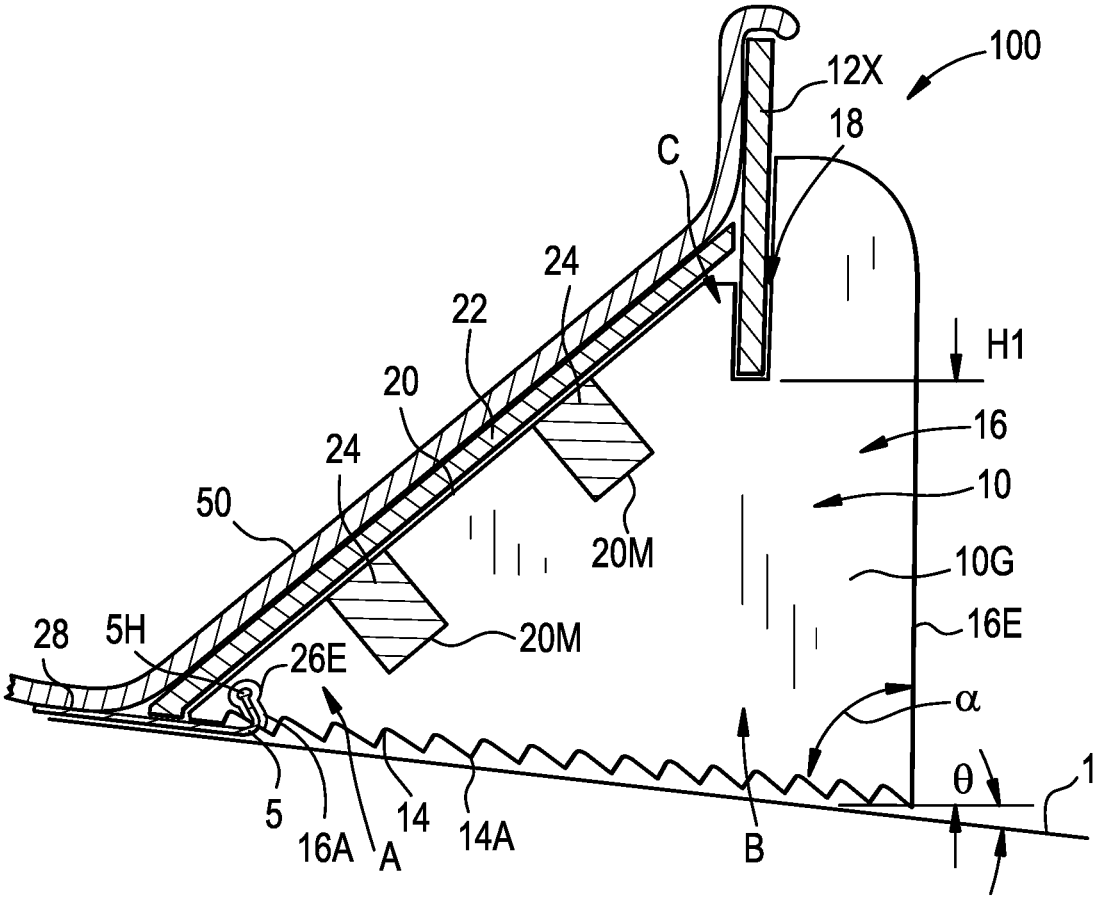
FIG. 2 depicts a side view of a retaining wall elevating structure incorporating the support members of FIG. 1A and a water impermeable liner.
Figure 3A:
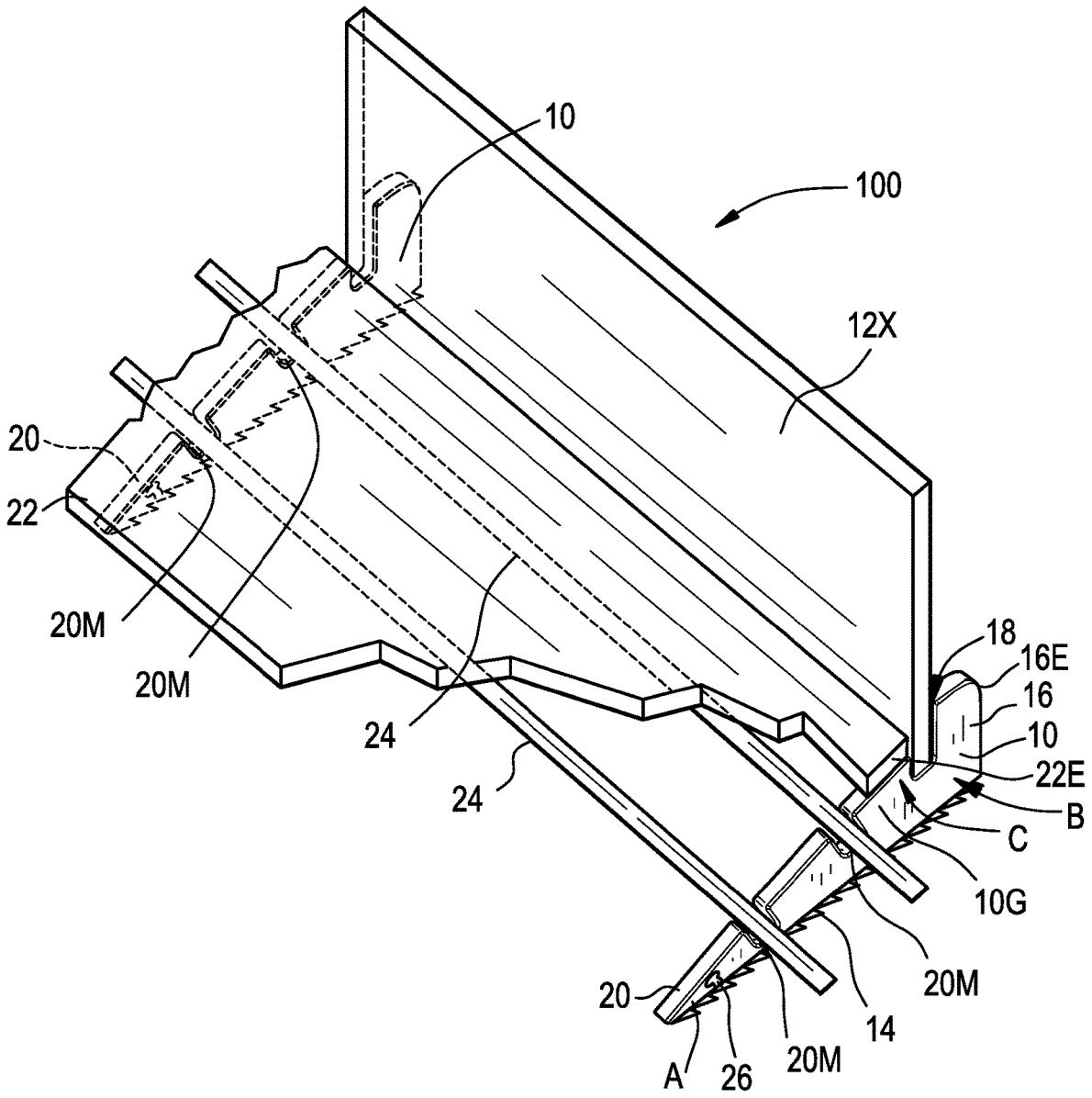
FIG. 3A depicts an isometric view of the retaining wall elevating structure of FIG. 2 with a portion of the load bearing panel omitted and a portion of the retaining wall elevating structure depicted in phantom.
Figure 3B:
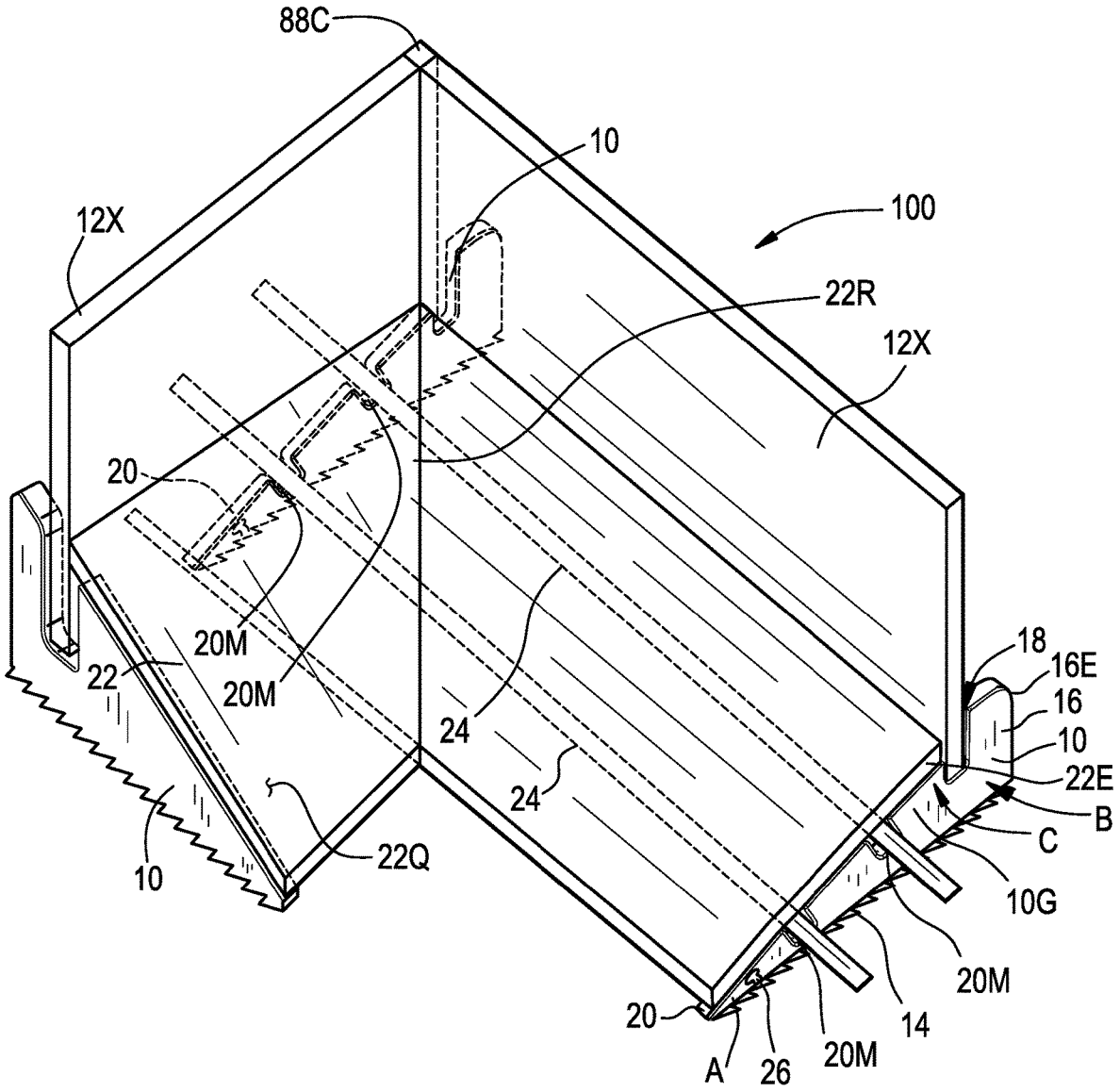
FIG. 3B depicts an isometric view of the retaining wall elevating structure of FIG. 2 with a corner portion and portion of the load bearing panel omitted and a portion of the retaining wall elevating structure depicted in phantom.

In the embodiments depicted in FIGS. 1A, 1C, 1D, 1E, 1F, 1G, 1H, and 1I, the sloped surface 20 includes two optional mounting areas 20M, each for receiving a lateral brace member 24 (depicted in FIGS. 2 and 3). Referring to FIG. 3A, the lateral brace member 24 is an additional support structure that engages the support member 10. The support member 10 depicted in FIG. 1B omits the mounting areas 20M discussed previously. In some embodiments, the support member 10 has a receiving area 26 for securing a tension member 5 thereto. In the embodiment depicted in FIG. 1A, the receiving area 26 is located proximate to the first area A. As depicted in the isolated view in FIG. 2, the tension member 5 engages the receiving area 26, travels under the base arrangement 14, travels under the lower end of the load bearing panel 22, and ultimately travels under the water impermeable liner 50 to connect to another support member 10 at the opposite end (see FIGS. 9A, 9B and/or 9C). In the depicted embodiment, the location of the receiving area 26 is proximate to the first area A. In other embodiments, the location of the receiving area 26 is at the second area B, between the first area A and the second area B, or along the edge 16E of the elevating section 16 between the second area B and third area C. Other locations for the receiving area 26 do not depart from the device disclosed herein. FIG. 3B illustrates further detail of the corner portion 88C and the seem 22R between adjacent panels 22Q and 22L.

Referring to FIG. 1G, the sloped surface 20 is at a first angle δ, relative to the base arrangement 14. In some embodiments, the first angle δ is between about 30 degrees and about 60 degrees. The height elevating section 16 includes an edge 16E oriented at a second angle α, relative to the base arrangement 14. In some embodiments, the second angle α is less than 90 degrees. In the embodiment depicted in FIG. 1A, the second angle α is about 87 degrees. The receiving area 18 is a slot defined by opposing side walls 18X, 18Y and a bottom 18B extending therebetween. The opposing side walls 18X, 18Y are oriented at a third angle σ relative to a reference line R, normal to the base arrangement 14. In the depicted embodiment, the third angle σ is less than the first angle δ such that the wall panel 12X is configurable in a vertical orientation when the base arrangement 14 is positioned on the mounting surface 1, as depicted in FIG. 2. In the embodiment depicted in FIG. 1E, the height elevating section 16 slopes inwardly, toward the first area A, such that the angle α is less than 87 degrees. In some embodiments, the height elevating section 16 slopes outwardly, away from the first area A.

Figure 4:
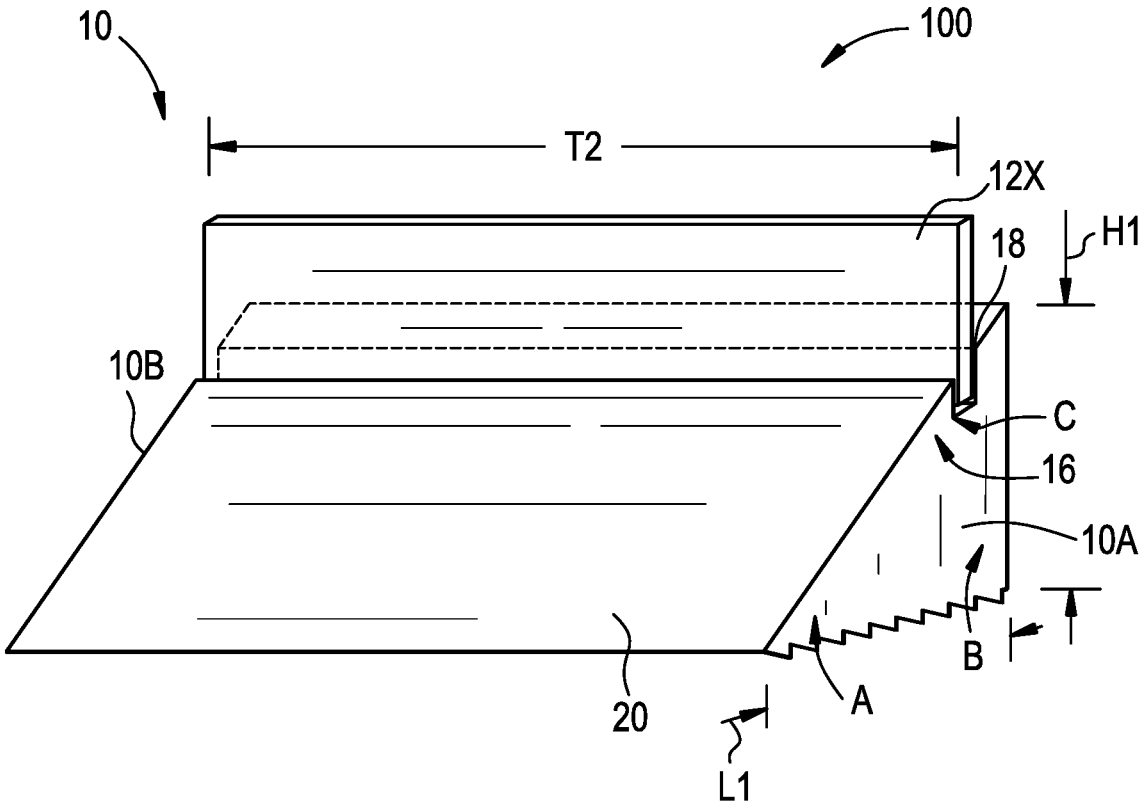
FIG. 4 depicts an isometric view of an alternative embodiment of a support member according to the present disclosure.

Referring to FIG. 1A, the bottom 18B of the receiving area 18 of the height elevating section 16 extends a height H1 above the base arrangement 14 (i.e., between the first area A and the third area C) and the base arrangement 14 extends a length L1 (i.e., between the first area A and the second area B). The support member 10 has an aspect ratio defined by the thickness T1 divided by a sum of the height H1 plus the length L1. The aspect ratio is a fractional number. In some embodiments, the aspect ratio is greater than 1.0. The aspect ratio of the support member 10 depicted in FIG. 4 is approximately 1.38.

In the embodiments depicted in FIGS. 1A, 1B, 1C, 1E, and 1F, the base arrangement 14, the height elevating section 16 and the sloped surface 20 form a substantially triangular shape. Other shapes, such as a polygon, trapezoid, hexagon, etc., do not depart from the scope of the device disclosed herein.

In the embodiment depicted in FIG. 1C, the support member 10 includes an opening 30 extending laterally therethrough. In the embodiment depicted in FIG. 1D, the base arrangement 14, the height elevating section 16, and the sloped surface 20 form an A-shape with a void 40 interrupting the base arrangement 14 of the support member 10. Referring to FIG. 1F, the support member 10 includes a lip 60 extending from the base arrangement 14 proximate to the first area A. The lip 60 has a panel receiving area 62 that receives an end of a load bearing panel 22 therein.

FIGS. 1H and 1I depict two embodiments in which the sloped surface 20 is arcuate. In the embodiment depicted in FIG. 1H, the sloped surface 20 is defined by a concave arcuate cross section to support a complementary load bearing panel 22. In the embodiment depicted in FIG. 1G, the sloped surface 20 is defined by a convex arcuate cross section to support a complementary load bearing panel 22. In some embodiments, the load bearing panel 22 is preformed in the complementary arcuate shape prior to installation on the sloped surface 20. In some embodiments, the load bearing panel 22 is flexible to match the contour of the sloped surface 20. In some embodiments, the flexible load bearing panel 22 is hardened to match the contour of the sloped surface 20.

In the depicted embodiments, the base arrangement 14 has an anti-skid feature 14A to increase the friction between the bottom of the base arrangement 14 and the mounting surface 1. In the depicted embodiments, the anti-skid feature 14A is a series of angled teeth extending from the base arrangement 14. Other features, such as pins, protrusions, ribs, or other means of increasing the friction between the base arrangement 14 and the mounting surface 1 do not depart from the device disclosed herein. In other embodiments, the lower surface of the base arrangement 14 is substantially smooth. In the depicted embodiments, the support member 10 is a unitary body, but other arrangements do not depart from the devices disclosed herein. In some embodiments, the base arrangement 14, the height elevating section 16, and the sloped surface 20 are separate pieces connected to one another. In some embodiments, a gusset 10G extends between the base arrangement 14, the height elevating section 16, and/or the sloped surface 20.

FIG. 4 depicts an alternate embodiment in which the support member 10 extends the length of the wall panel 12X and has a first side face 10A and a second side face 10B defining a lateral thickness T2 therebetween. The aspect ratio of the support member 10 depicted in FIG. 4 is approximately 1.38. In some embodiments, the aspect ratio is between 0.01 and 0.15.

Referring to FIG. 2, a retaining wall elevating structure 100 incorporates the support members 10. A load bearing panel 22 is disposed on the sloped surface 20 of the support members 10. In the depicted embodiment, the load bearing panel 22 extends in a sloped manner between the mounting surface 1 proximate to the first area A to the height elevating section 16 proximate to the third area C. In the depicted embodiment, the retaining wall elevating structure 100 includes a wall panel 12X positioned substantially vertically in the receiving area 18 of the height elevating section 16. A water impermeable liner 50 drapes over the wall panel 12X and the load bearing panel 22. In the depicted embodiment, the load bearing panel 22 is disposed on and extends over two support members 10. Two (optional) lateral brace members 24 extend between the support members 10. The lateral brace members 24 provide further support for the load bearing panel 22.

Figure 5A:
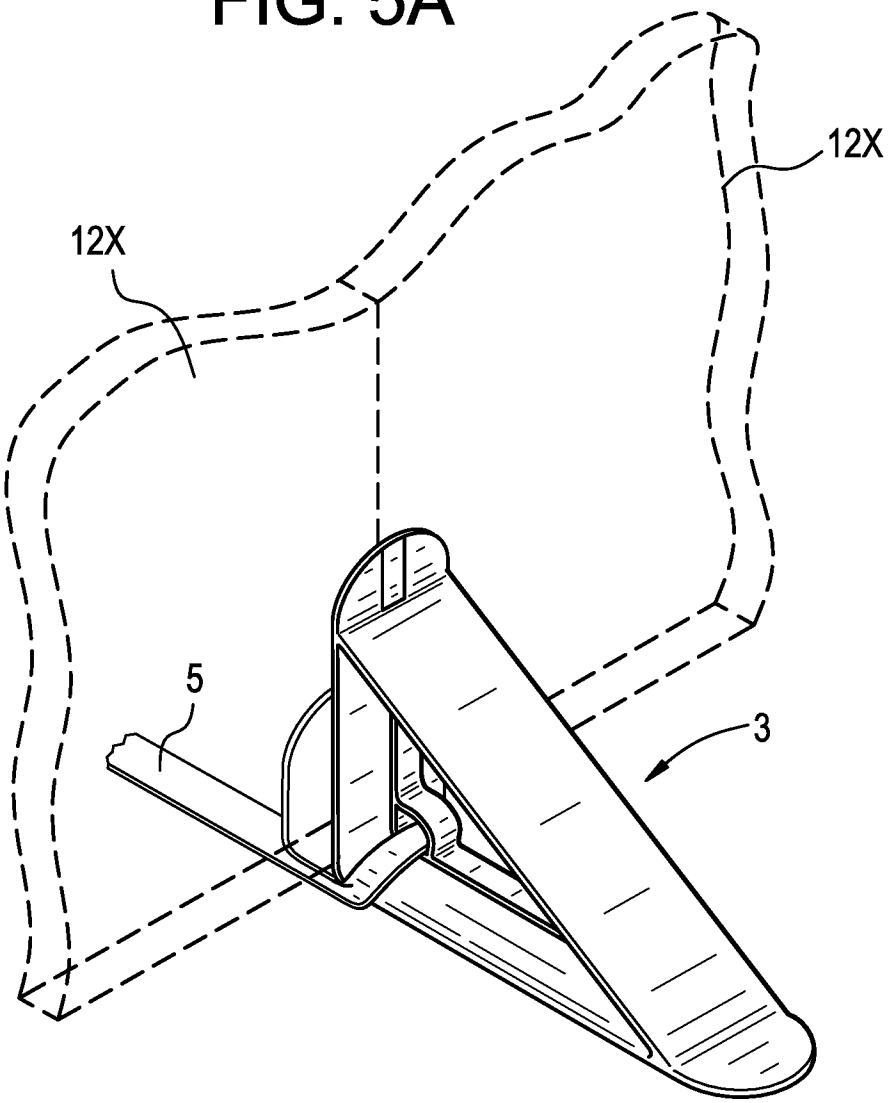
FIG. 5A depicts an isometric view of a bracket with the wall panel depicted in phantom.
Figure 5B:
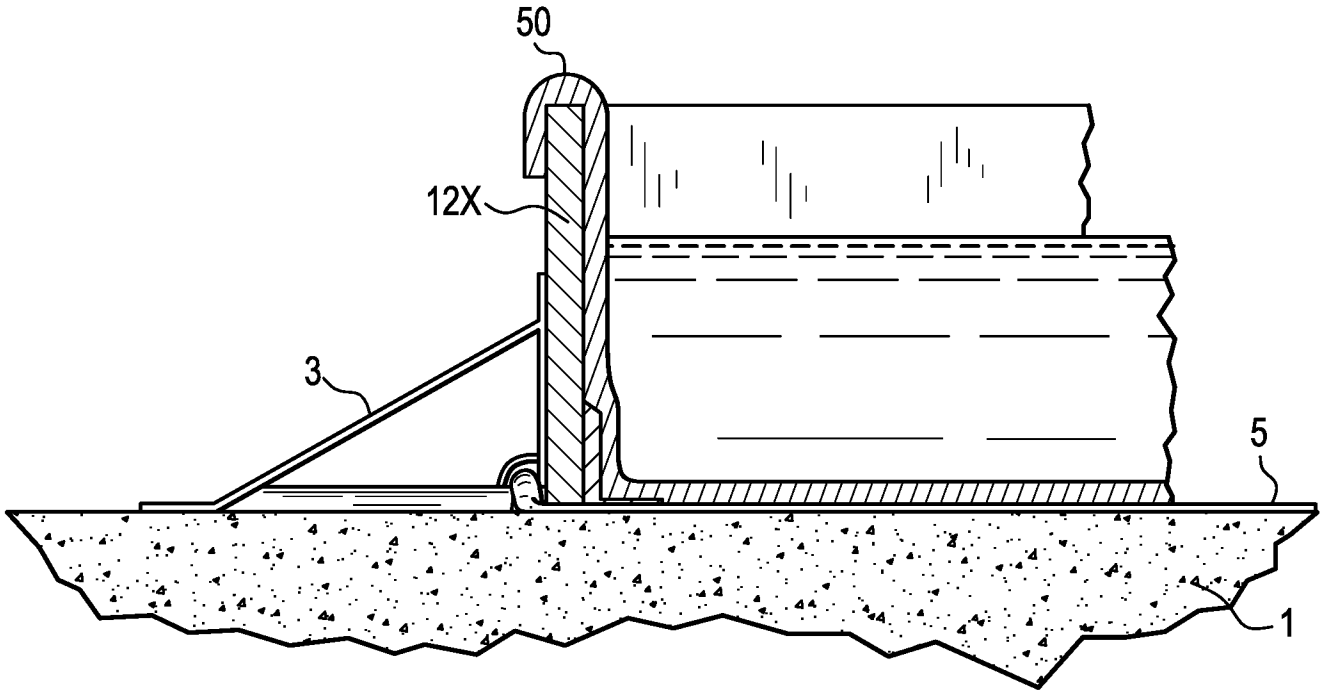
FIG. 5B depicts a side view of the bracket of FIG. 5A in an assembled state.

In the embodiments depicted in FIGS. 1A-1I and 2, the support member 10 is positioned inwardly of the wall panel 12X. This arrangement is the opposite of that provided by a bracket 3, as depicted in FIGS. 5A and 5B. The majority of the depicted bracket 3 is positioned outside of the wall panels 12X (e.g., outside the perimeter of the ice rink). A tension member 5 reaches below the wall panels 12X to mate with the bracket 3 outside of the perimeter of the ice rink. In the depicted embodiment, the bracket 3 supports a joint between two adjacent wall panels 12X. In other embodiments, the bracket 3 supports a single wall panel 12X. The bracket 3 does not accommodate mounting surfaces with a total slope greater than one foot.

Figure 6:
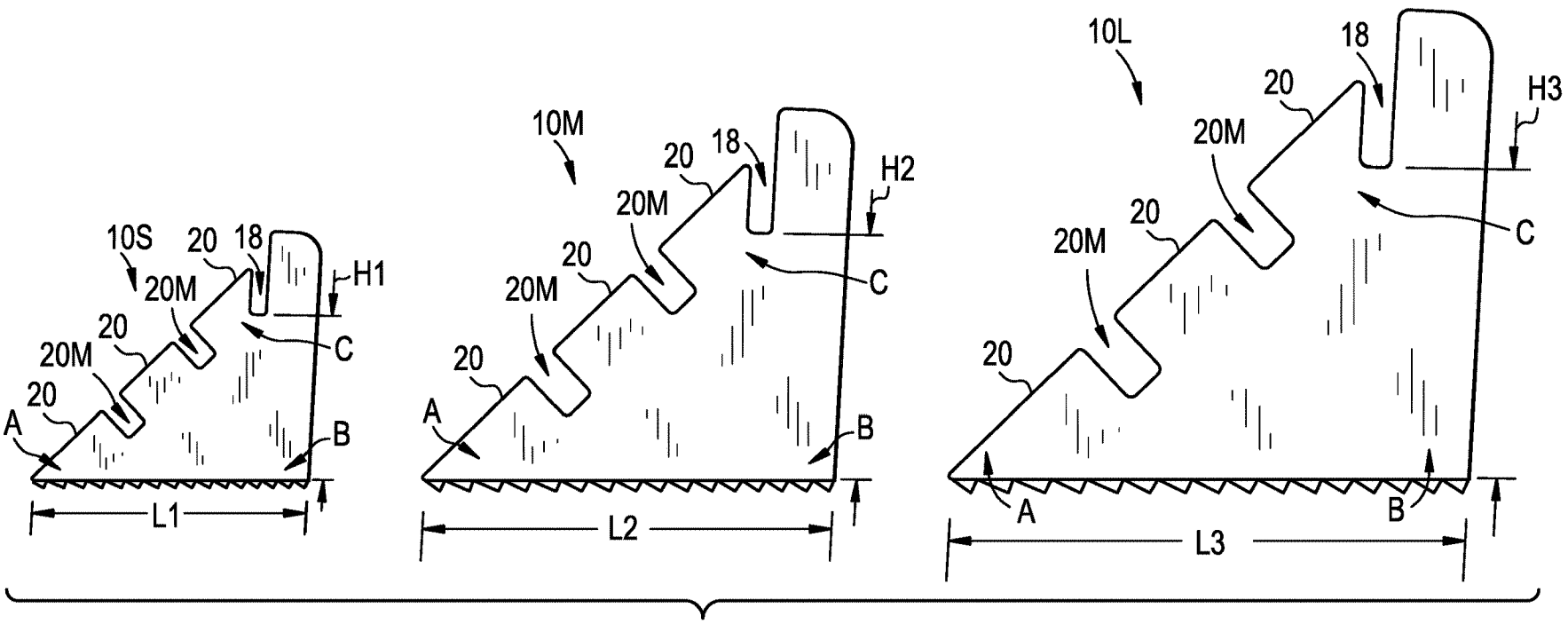
FIG. 6 depicts a first support member size, a second support member size, and a third support member size with similar structures to the support member of FIG. 1A.

FIGS. 7A-9 depict a retaining wall system 1000 installed on a sloped mounting surface 1 including a number of support members similar in structure to the support member 10, but having three different sizes. There is a first support member size 10S, a second support member size 10M, and a third support member size 10L. The first support member size 10S is smaller than the second support member size 10M and the second support member size 10M is smaller than the third support member size 10L. The three support members 10S, 10M, 10L are depicted side by side for the purposes of comparison in FIG. 6. The depicted first support member size 10S has a height elevating section 16 that extends a first height H1 and a base arrangement 14 that extends a first length L1. The depicted second support member size 10M has a height elevating section 16 that extends a second height H2 and a base arrangement 14 that extends a second length L2. The depicted third support member size 10L has a height elevating section 16 that extends a third height H3 and a base arrangement 14 that extends a third length L3. In the depicted embodiment, the first support member size 10S, the second support member size 10M, and the third support member size 10L all have a structure similar to the support member 10 depicted in FIG. 1A. In some embodiments of the retaining wall system 1000, two different sized support members (i.e., one support member 10S and one support member 10M, one support member 10M and one support member 10L, etc.) are connected to a single wall panel 12X.

Figure 7A:
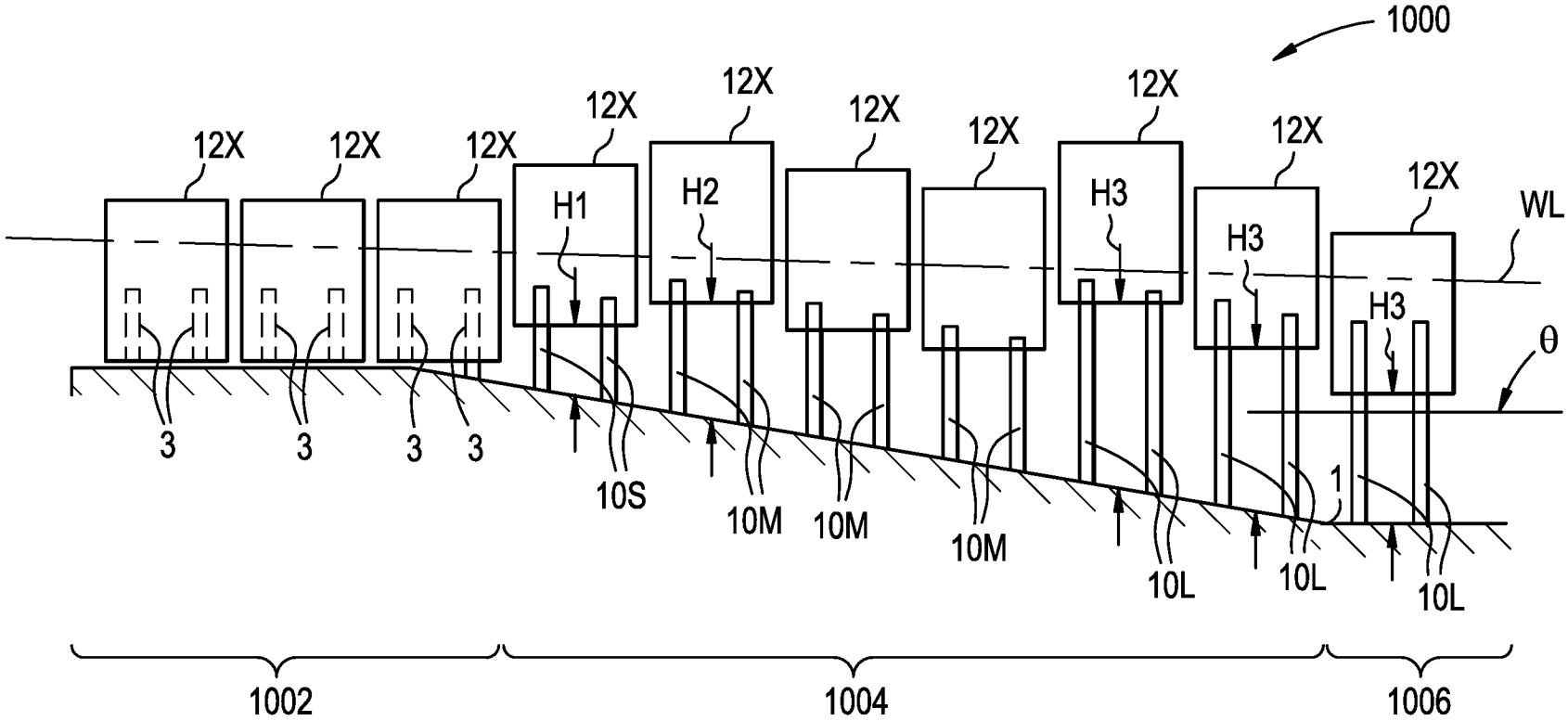
FIG. 7A depicts a retaining wall system that incorporates the support members of FIG. 6 to accommodate a sloped mounting surface.
Figure 7B:
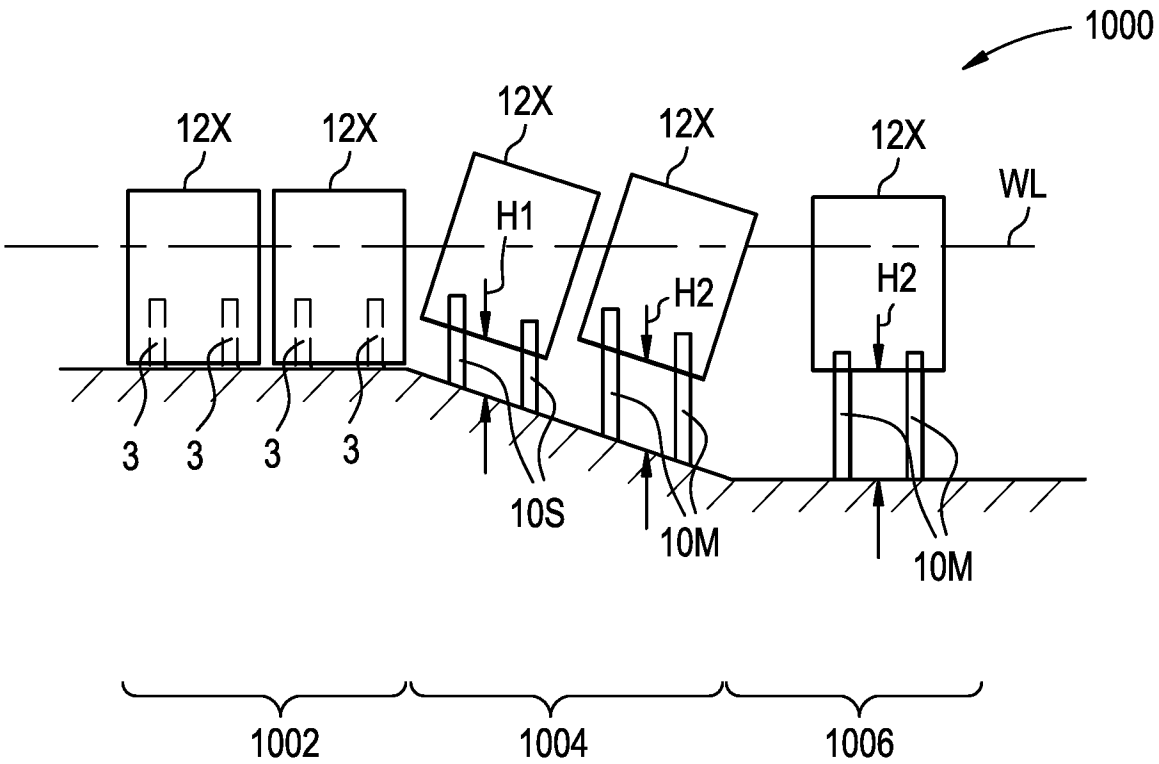
FIG. 7B depicts an illustrative embodiment of a retaining wall system incorporating the support members of FIG. 6 installed on a mounting surface with a steeper slope than that of FIG. 7A.
Figure 8:
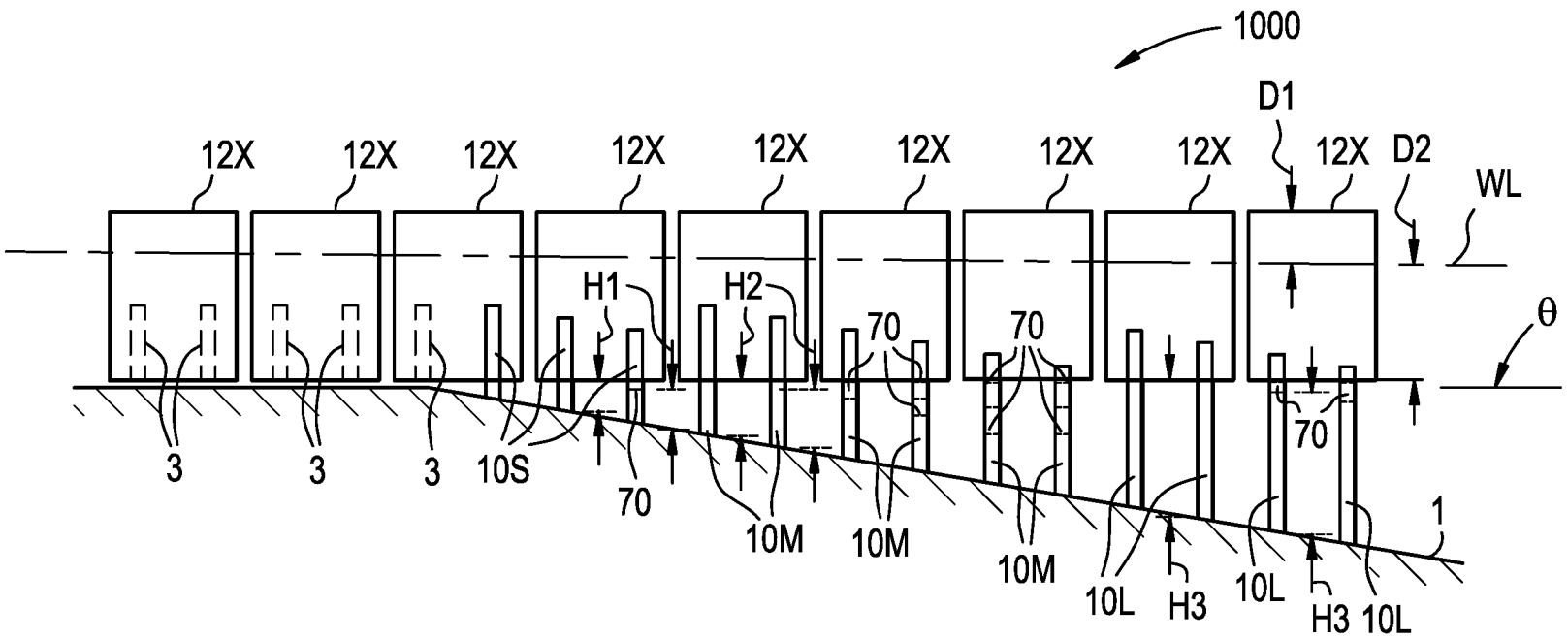
FIG. 8 depicts the retaining wall system of FIG. 7A incorporating shims to raise the wall panels to the same level.

Referring to FIGS. 7A and 8, a wall panel 12X is disposed in each adjacent pair of the support members 10 such that the wall panels 12X all intersect a horizontal water level WL. In the depicted embodiments, all wall panels 12X have substantially the same size, but incorporating wall panels of different sizes does not depart from the device disclosed herein. FIG. 7A depicts a mounting surface 1 that slopes downward from left to right an angle θ. The depicted mounting surface 1 extends from a first level surface 1002 to a second level surface 1006 with a sloped surface 1004 therebetween. In the depicted embodiment, the sloped surface 1004 is relatively constant and canted at a relatively small angle. The support members disclosed herein also accommodate steeper slopes, as discussed below with respect to FIG. 7B. Referring to FIG. 7A, the water that will ultimately freeze into ice fills the retaining wall system 1000 up to a water level line WL. A water impermeable liner 50 (not depicted) is laid over the retaining wall system 1000, overlapping the wall panels 12X, to retain the water that ultimately freezes into ice. In order for the wall panels 12X to be used for the entire perimeter of the retaining wall system 1000 each wall panel 12X must be raised at least to the height of the water level WL. This prevents the water from spilling out of the retaining wall system 1000 prior to freezing into ice and high enough to retain objects such as hockey pucks. The first support member size 10S raises the wall panel 12X contained therein to the first height H1. The second support member size 10M raises the wall panels 12X contained therein to the second height H2. The third support member size 10L raises the wall panels 12X contained therein to the third height H3.

FIG. 7B depicts a retaining wall system 1000 similar to that depicted in FIG. 7A, but installed on and accommodating a mounting surface 1 with an extremely steep slope for angled portion 1004. Two first support member sizes 10S, 10S raise a wall panel 12X a distance H1 and two second support member sizes 10M, 10M raise a wall panel 12X a distance H2, both measured relative to the angled portion 1004 of the mounting surface 1. In the depicted embodiment, the angle of the angled surface 1004 is exaggerated for illustrative purposes only.

Figure 10:
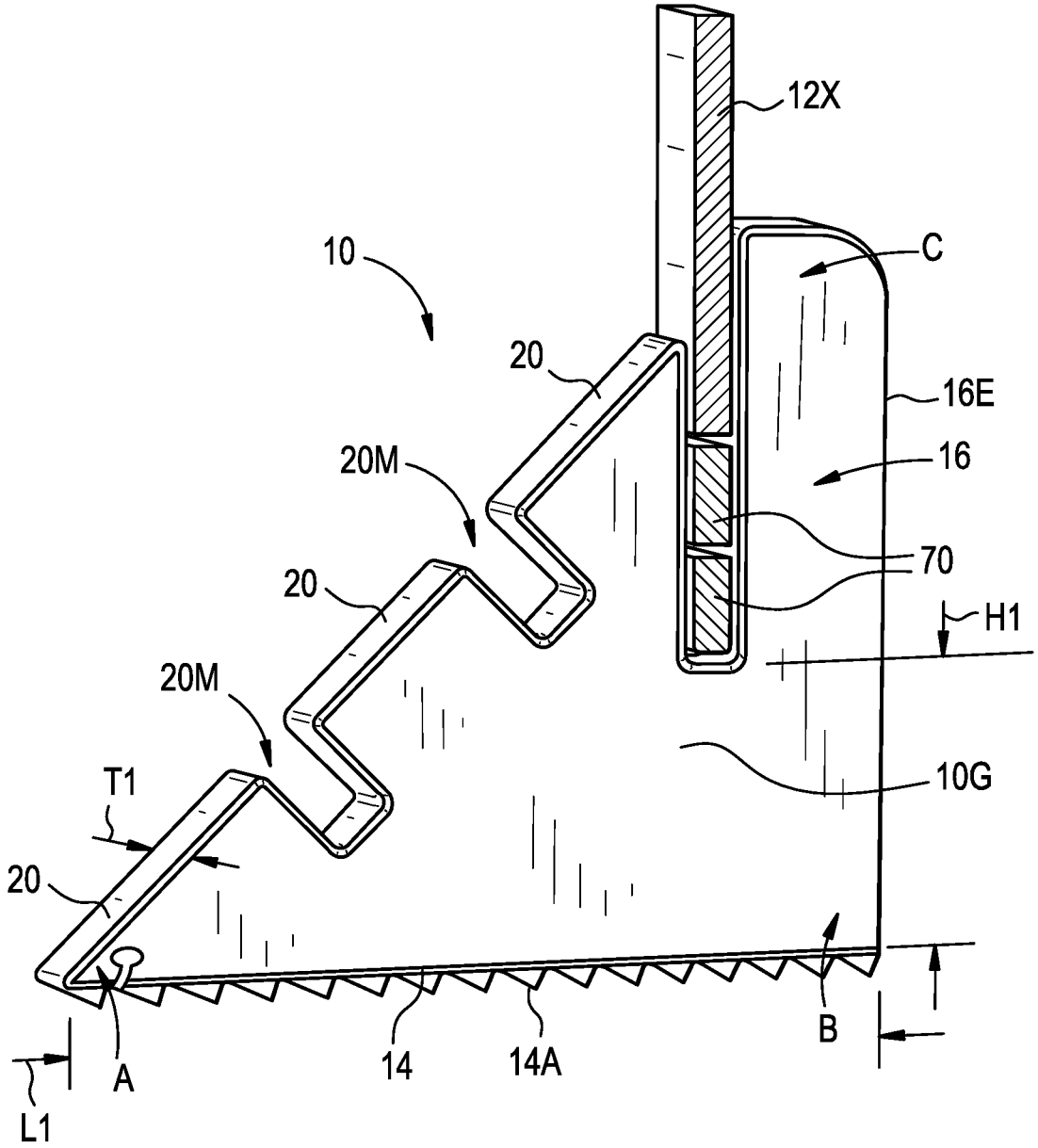
FIG. 10 depicts a side view of the support member of FIG. 1A incorporating two shims below the wall panel.

In the embodiments depicted in FIGS. 8 and 10, a customizable number of shims 70 are placed in the receiving areas 18 to adjust a height of the wall panels 12X. Referring to FIG. 8, as the mounting surface 1 slopes downward, from left to right in the figure, the bottom 18B of each receiving area 18 is at lower positions than the previous receiving area 18, relative to the water line WL, resulting in lower positions of each successive wall panel 12X (as depicted in FIG. 7A). In some cases, inserting one or more shims 70 into the receiving area 18 (depicted in detail in FIG. 10) is sufficient to raise the engagement point with the wall panel 12X, thereby allowing the wall panel 12X to remain horizontally oriented and at the desired depth D2 relative to the water line WL. In the depicted embodiment, all wall panels 12X extend a first distance D1 above the water line WL. In some embodiments, the wall panels 12X extend different distances above the water line WL. In other cases, the second support member size 10M or the third support member size 10L alone or in combination with one or more shims 70 is necessary to maintain the desired orientation and depth of the wall panel 12X.

Figure 9A:
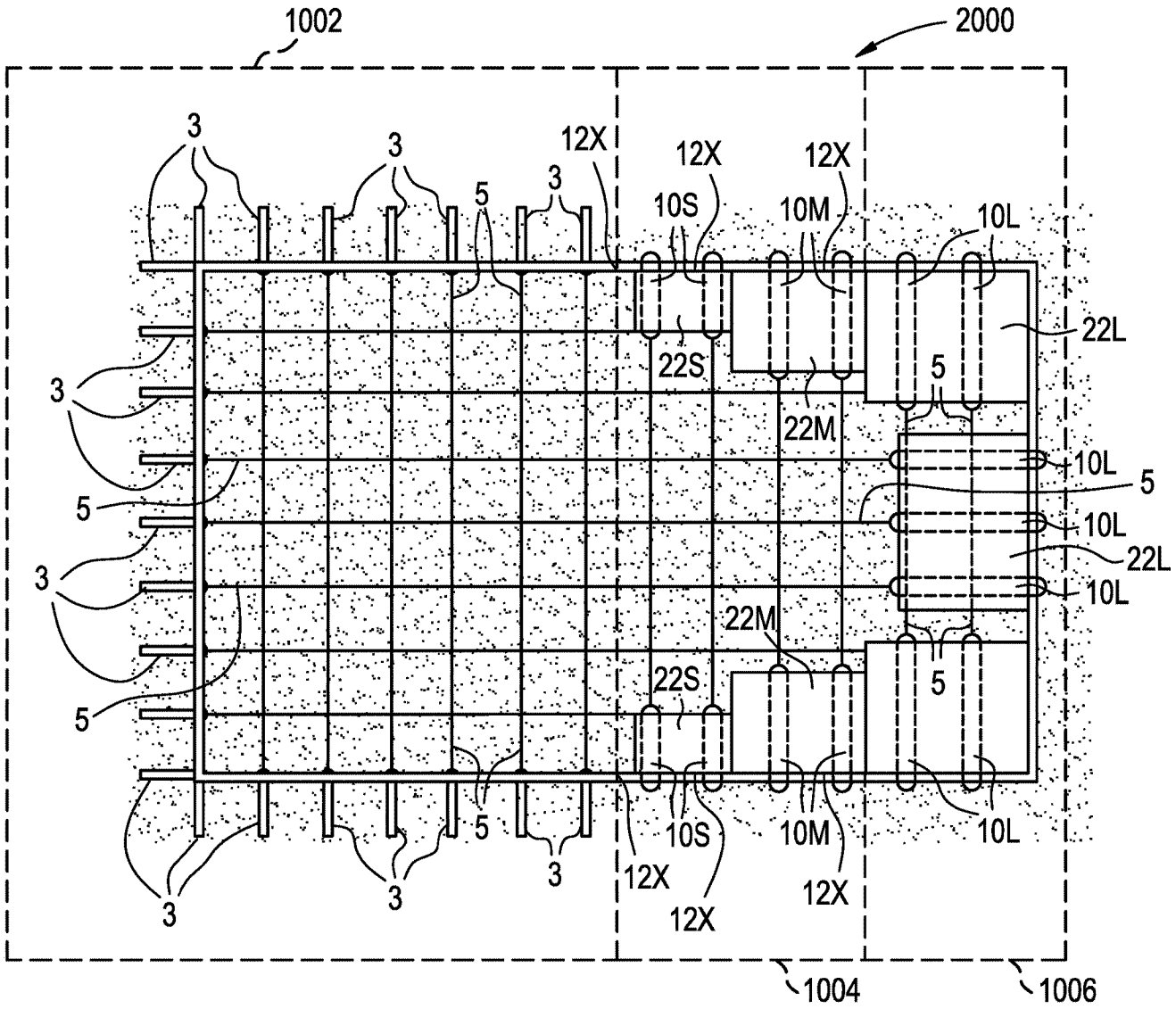
FIGS. 9A and 9B an ice skating rinks incorporating both the prior art brackets of FIGS. 5A and 5B and the retaining wall system of FIG. 8.

FIG. 9A depicts an ice skating rink 2000 incorporating the retaining wall system 1000 disclosed herein. The slope of the underlying mounting surface 1 of FIG. 9A is similar to that depicted in FIG. 7A. Approximately half of the perimeter formed by the wall panels 12X is supported by brackets 3 on the outside of the perimeter. The wall panels 12X assembled on the first level surface 1002 are supported by the brackets 3; the wall panels 12X assembled on the sloped surface 1004 are supported by the support members 10S, 10M, and 10L; and the wall panels 12X assembled on the second level surface 1006 are supported by the support members 10L.

Incorporating brackets 3 in this manner is possible because the underlying portion of the mounting surface 1 is relatively level. As the mounting surface 1 slopes downwards, support members 10S, 10M, and 10L are necessary to maintain the wall panels 12X in the preferred orientations and at the preferred depths (in the depicted embodiment, the preferred depth is designated by the lower end of the wall panel 12X measuring D1 from the water line WL). In some embodiments, the preferred depth varies around the perimeter of the retaining wall system 1000 and in other embodiments the preferred depth varies based on time of year or other factors related to water retention and freezing ability.

Figure 9B:
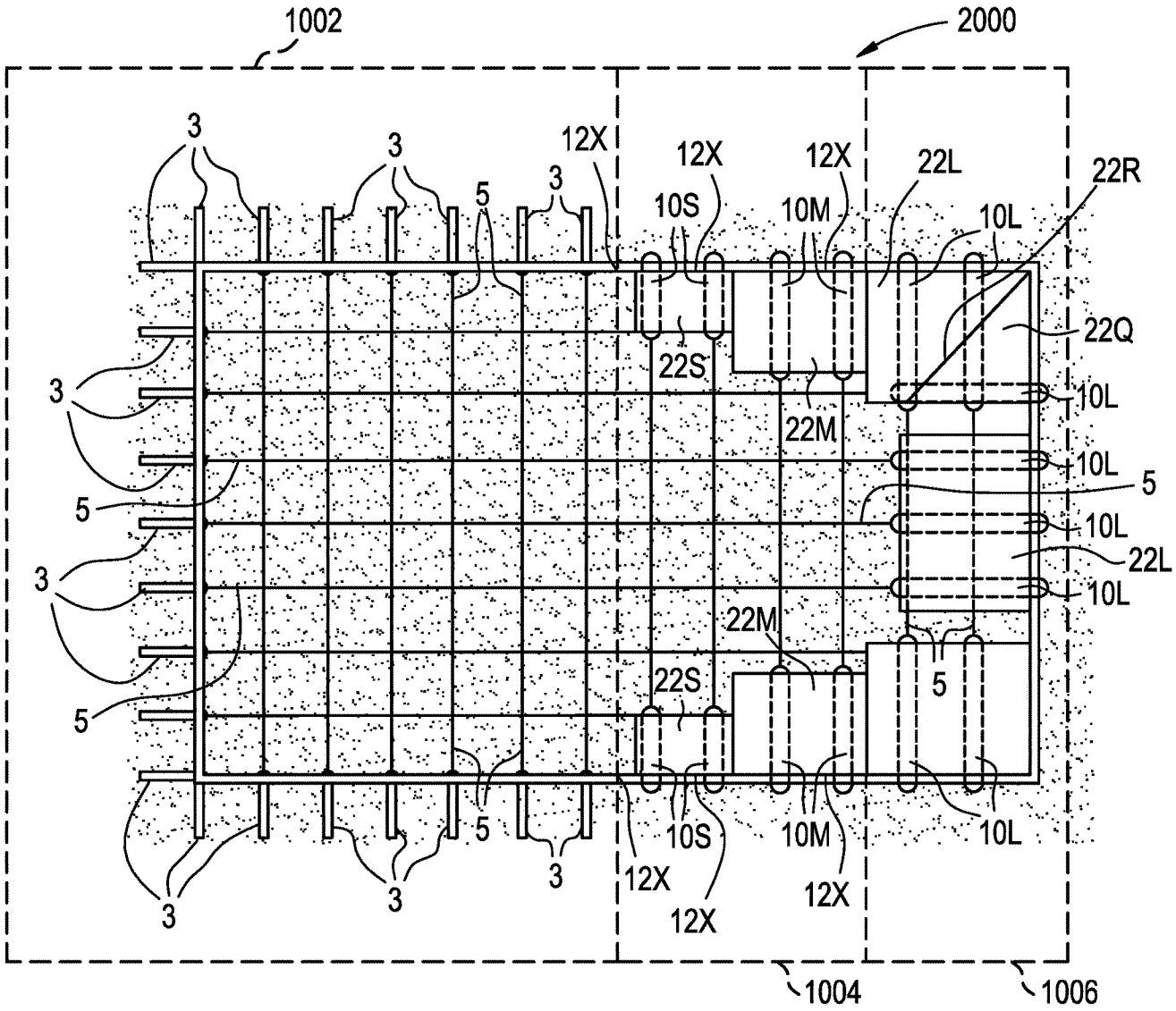
Figure 9C:
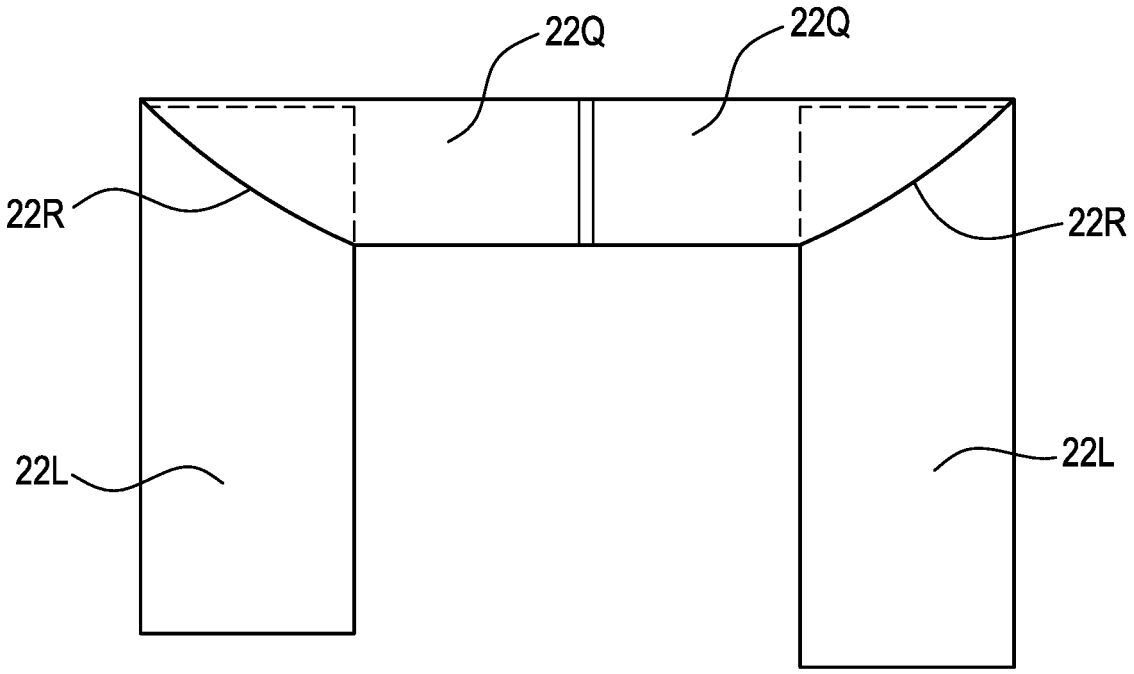
FIG. 9C is a top view of a portion of the ice skating rink of FIG. 9B showing corner detail.

In some embodiments, the ice skating rink 2000 includes tension members 5 extending under the water impermeable liner 50 and in frictional engagement with the mounting surface 1. Referring to FIG. 9A, each depicted tension member 5 secures to each of two generally opposing support members 10. In some embodiments, multiple tension members 5 extend under the water impermeable liner 50 and are in frictional engagement with the mounting surface 1. In the depicted embodiment, tension members 5 connect a bracket 3 to an opposite bracket 3, a bracket 2 to an opposite support member 10L, and a support member 10S to an opposite support member 10S. In some embodiments, a tension member connects two support members of different sizes. FIGS. 9B and 9C illustrate an alternate embodiment of FIG. 9A showing corner detail including corner seem 22R (e.g., mating surfaces) between slanted corner panels 22Q and 22L.

Figure 11:
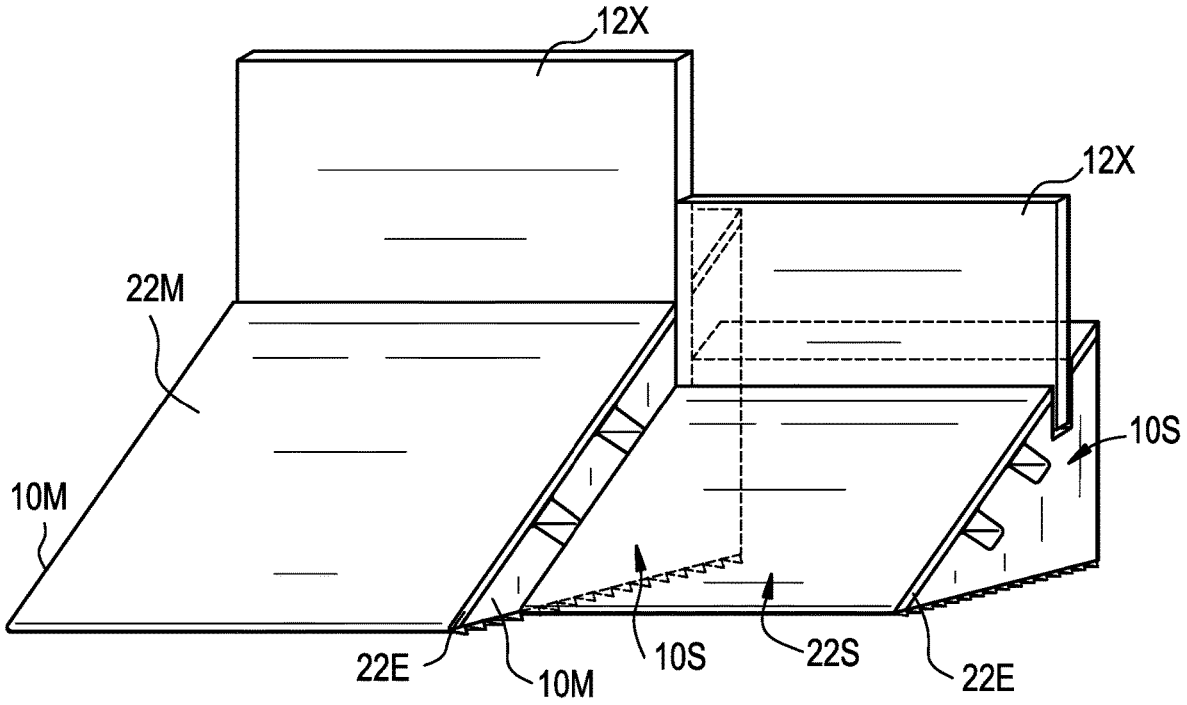
FIG. 11 depicts an isometric view of a portion of the ice skating rink of FIGS. 9A, 9B and/or 9C.

FIG. 11 depicts two adjacent retaining wall elevating structures. One retaining wall elevating structure has two second support member sizes 10M, 10M, a second load bearing panel 22M, and a wall panel 12X. The adjacent wall elevating structure has two first support member sizes 10S, 10S, a first load bearing panel 22S, and a wall panel 12X. In the depicted embodiment, the support members are mounted flush with each edge 22E of the load bearing panels. This allows the second support member size 10M to form a barrier between the adjacent load bearing panels 22M, 22S. This is especially important when adjacent load bearing panels are different sizes, as depicted in FIG. 11, because the water impermeable liner (not depicted) can penetrate a void between the load bearing panels. In some cases, if the water impermeable liner penetrates a void such as this, the water impermeable liner and/or the retaining wall elevating structures are significantly damaged or otherwise compromised.

Figure 12:
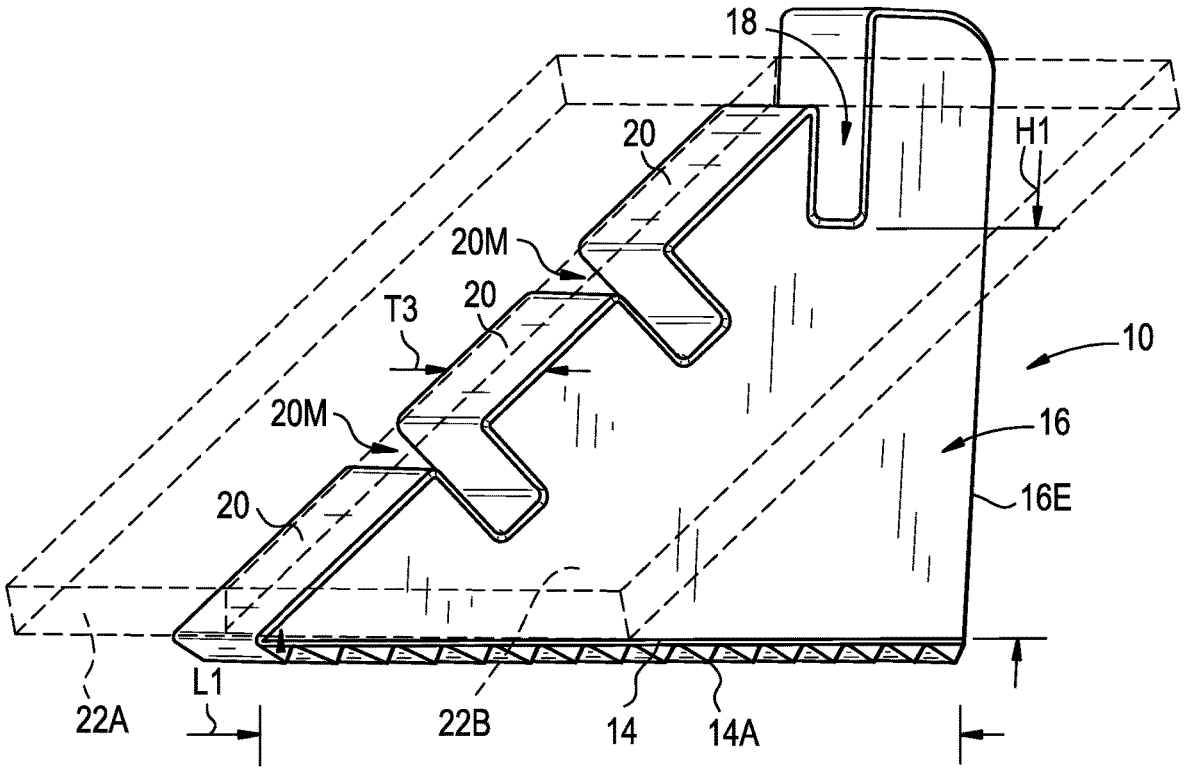
FIG. 12 depicts an isometric view of another alternative embodiment of a support member according to the present disclosure including a load bearing panel depicted in phantom.

FIG. 12 depicts an alternate embodiment of the support member 10, having a thickness T3 that is much larger than T1 as discussed with respect to FIGS. 1A-1I. In the depicted embodiment, T3 is approximately twice as large as T1. The aspect ratio of the support member 10 depicted in FIG. 12 is approximately 0.07. This thickness allows a single support member 10 to hold up two adjacent load bearing panels 22A, 22B. This allows a retaining wall elevating structure 1000 to fully support two adjacent load bearing panels 22A, 22B using only three support members 10.

In some embodiments, the water impermeable liner is oversized to allow for adjustment of the liner and modification of the ice skating rink's 2000 size and/or shape. The disclosed retaining wall elevating structure 1000 can easily be constructed using boards made from either plastic, lumber, plywood, carbon fiber, fiberglass, composite or some other synthetic or other material. The disclosed ice skating rink 2000 can include boards which are used to form the perimeter of the rink with no holes, grooves or other modifications such as incorporating plywood boards or other inserts to allow them to connect with the provided support members 10. In some embodiments, the support members 10, the wall panels 12X, the shims 70, and/or the load bearing panels 22 are made from materials including plastic, polymer, molded, wood in the form of plywood or lumber boards (e.g., two inch by four inch board, two inch by ten inch board, etc.), and metal. In some embodiments, the support members 10 include weight reduction features such as depressions and/or strength increasing features such as ribs. In some embodiments, the support members 10 are hollow.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A support member for elevating a retaining wall panel, the support member comprising:

a base arrangement having a first area and a second area, the base arrangement being configured to engage a mounting surface;

a height elevating section extending from the base arrangement proximate the second area to a third area, the height elevating section having a receiving area configured to receive the retaining wall panel; and a sloped surface extending between the base arrangement proximate the first area and the height elevating section proximate the third area, the sloped surface being configured to support a load bearing panel extending between the first area and the third area, wherein the sloped surface is at a first angle relative to the base arrangement, wherein the first angle is from about 30 degrees to about 60 degrees, wherein the receiving area comprises a slot defined by opposing side walls and a bottom extending therebetween, and wherein the opposing side walls are oriented at a third angle that is less than the first angle such that the retaining wall panel is configurable in a vertical orientation when the base arrangement is positioned on the mounting surface.

2. The support member of claim 1, wherein the sloped surface comprises at least one mounting area for receiving a lateral brace member.

3. The support member of claim 1, further comprising a receiving area proximate the first area for securing a tension member thereto.

4. The support member of claim 1, wherein the base arrangement comprises an anti-skid feature.

5. The support member of claim 1 comprised of a unitary body.

6. The support member of claim 1, further comprising a gusset extending between the base arrangement, the height elevating section and the sloped surface.

7. The support member of claim 1, wherein the base arrangement, the height elevating section and the sloped surface are connected to one another.

8. The support member of claim 1, wherein the base arrangement, the height elevating section and the sloped surface form one of a triangular shape and a A-shape.

9. The support member of claim 1, further comprising a first side face and a second side face defining a lateral thickness between the first side face and the second side face.

10. The support member of claim 9, wherein the height elevating section extends a height and the base arrangement extends a length, and the support member has an aspect ratio equal to the thickness divided by (a sum of the height plus the length).

11. The support member of claim 10, wherein the aspect ratio is a fractional number.

12. The support member of claim 10, wherein the aspect ratio is greater than 1.0.

13. The support member of claim 1, wherein the height elevating section comprises an edge oriented at a second angle relative to the base arrangement, the second angle being less than 90 degrees.

14. The support member of claim 1, wherein the height elevating section comprises an edge oriented at a second angle relative to the base arrangement, the second angle being about 87 degrees.

15. The support member of claim 1, wherein the height elevating section slopes inwardly toward the first area.

16. The support member of claim 1, wherein the height elevating section slopes outwardly away from the first area.

17. The support member of claim 1, wherein the height elevating section is positioned a predetermined distance above the mounting surface.

18. A retaining wall elevating structure comprising:

at least one of the support members of claim 1; and a load bearing panel disposed on the at least one support member.

19. The retaining wall elevating structure of claim 18, wherein the load bearing panel extends in a sloped manner between the mounting surface proximate the first area to the height elevating section proximate the third area.

20. The retaining wall elevating structure of claim 18, wherein the retaining wall panel is positioned substantially vertically in the receiving area of the height elevating section.

21. The retaining wall elevating structure of claim 20, wherein the at least one support member is positioned substantially inwardly of the retaining wall panel.

22. The retaining wall elevating structure of claim 18, further comprising a water impermeable liner draped over the retaining wall panel and the load bearing panel.

23. A retaining wall system comprising the retaining wall elevating structure of claim 22, wherein the at least one support member comprises a plurality of support members, which comprises a first support member of a first size, a second support member of a second size, and a third support member of a third size, and wherein the first size is smaller than the second size, and the second size is smaller than the third size.

24. The retaining wall system of claim 23, wherein the respective retaining wall panel is disposed in each adjacent pair of the plurality of support members so that each retaining wall panel intersects a horizontal water level.

25. The retaining wall system of claim 23, further comprising at least one shim disposed in the receiving area to adjust a height of the retaining wall panel.

26. An ice skating rink comprising the retaining wall system of claim 23.

27. The ice skating rink of claim 26, wherein the plurality of support members are positioned substantially inside the ice skating rink.

28. The ice skating rink of claim 26, further comprising a water impermeable liner draped over the retaining wall panel and the load bearing panel; and a plurality of tension members extending under the water impermeable liner and in frictional engagement with the mounting surface, one of the plurality of tension members being secured to each of two generally opposing support members of the support members.

29. The ice skating rink of claim 26, further comprising a water impermeable liner draped over the retaining wall panel and the load bearing panel; and a plurality of tension members extending under the water impermeable liner and in frictional engagement with the mounting surface, one of the tension members being secured to one of the support members and a bracket.

30. A retaining wall elevating structure, comprising:

a load bearing panel; and at least two of the support members of claim 1 wherein the load bearing panel is disposed on and extends over the at least two support members.

31. The retaining wall elevating structure of claim 30, further comprising at least one lateral brace member extending between the at least two support members.

32. The retaining wall elevating structure of claim 31, wherein the load bearing panel is supported by the at least one lateral brace member.

33. A retaining wall elevating structure, comprising:

support members for elevating retaining wall panels, the support members each comprising:

a base arrangement having a first area and a second area, the base arrangement being configured to engage a mounting surface;

a height elevating section extending from the base arrangement proximate the second area to a third area, the height elevating section having a receiving area configured to receive a retaining wall panel of the retaining wall panels; and a sloped surface extending between the base arrangement proximate the first area and the height elevating section proximate the third area; and load bearing panels disposed on the support members, wherein the sloped surface is configured to support a load bearing panel of the load bearing panels that extends between the first area and the third area, wherein the support members comprise support members of a first support member size, support members of a second support member size, and support members of a third support member size, wherein the first support member size is less than the second support member size, and the second support member size is less than the third support member size, and wherein the retaining wall panels are respectively disposed in each adjacent pair of the support members so that the retaining wall panels all intersect a horizontal water level.

34. A retaining wall elevating structure, comprising:

support members for elevating retaining wall panels, the support members each comprising:

a base arrangement having a first area and a second area, the base arrangement being configured to engage a mounting surface;

a height elevating section extending from the base arrangement proximate the second area to a third area, the height elevating section having a receiving area configured to receive a retaining wall panel of the retaining wall panels; and a sloped surface extending between the base arrangement proximate the first area and the height elevating section proximate the third area;

at least one shim disposed in the receiving area of at least one of the support members to adjust a height of at least one of the retaining wall panels; and load bearing panels disposed on the support members, wherein the sloped surface is configured to support a load bearing panel of the load bearing panels that extends between the first area and the third area, wherein the support members comprise support members of a first support member size, support members of a second support member size, and support members of a third support member size, and wherein the first support member size is less than the second support member size, and the second support member size is less than the third support member size.

35. An ice skating rink, comprising:

support members for elevating retaining wall panels, the support members each comprising:

a base arrangement having a first area and a second area, the base arrangement being configured to engage a mounting surface;

a height elevating section extending from the base arrangement proximate the second area to a third area, the height elevating section having a receiving area configured to receive a retaining wall panel of the retaining wall panels; and a sloped surface extending between the base arrangement proximate the first area and the height elevating section proximate the third area;

load bearing panels disposed on the support members;

a water impermeable liner draped over the retaining wall panels and the load bearing panels; and tension members extending under the water impermeable liner and in frictional engagement with the mounting surface, one of the tension members being secured to each of two generally opposing support members of the support members, wherein the sloped surface is configured to support a load bearing panel of the load bearing panels that extends between the first area and the third area.

36. An ice skating rink, comprising:

support members for elevating retaining wall panels, the support members each comprising:

a base arrangement having a first area and a second area, the base arrangement being configured to engage a mounting surface;

a height elevating section extending from the base arrangement proximate the second area to a third area, the height elevating section having a receiving area configured to receive a retaining wall panel of the retaining wall panels; and a sloped surface extending between the base arrangement proximate the first area and the height elevating section proximate the third area;

load bearing panels disposed on the support members;

a water impermeable liner draped over the retaining wall panels and the load bearing panels; and tension members extending under the water impermeable liner and in frictional engagement with the mounting surface, one of the tension members being secured to one of the support members and a bracket.

* * * * *